US006318090B1

(12) United States Patent
Gschneidner, Jr. et al.

(10) Patent No.: US 6,318,090 B1
(45) Date of Patent: Nov. 20, 2001

(54) DUCTILE MAGNETIC REGENERATOR ALLOYS FOR CLOSED CYCLE CRYOCOOLERS

(75) Inventors: Karl A. Gschneidner, Jr.; Vitalij K. Pecharsky; Alexandra O. Pecharsky, all of Ames, IA (US)

(73) Assignee: Iowa State University Research Foundation, Inc., Ames, IA (US)

( * ) Notice: Subject to any disclaimer, the term of this patent is extended or adjusted under 35 U.S.C. 154(b) by 0 days.

(21) Appl. No.: 09/395,423

(22) Filed: Sep. 14, 1999

(51) Int. Cl.[7] ..... F25B 9/00
(52) U.S. Cl. ..... 62/6
(58) Field of Search ..... 62/6

(56) References Cited

U.S. PATENT DOCUMENTS

| | | | | |
|---|---|---|---|---|
| 5,124,215 | * | 6/1992 | Hashimoto | 428/611 |
| 5,186,765 | * | 2/1993 | Arai et al. | 148/301 |
| 5,269,854 | * | 12/1993 | Takahashi et al. | 148/301 |
| 5,332,029 | * | 7/1994 | Tokai et al. | 165/4 |
| 5,537,826 | * | 7/1996 | Gschneidner et al. | 62/6 |
| 5,593,517 | * | 1/1997 | Saito et al. | 148/301 |
| 6,003,320 | * | 12/1999 | Okamura et al. | 62/6 |
| 6,022,486 | * | 2/2000 | Tokai et al. | 252/67 |

OTHER PUBLICATIONS

"Cryogenic Regenerative Heat Exchangers", *Plenum Press*, New York, 1997, by R. A. Ackerman.

"Cryocoolers Part 1: Fundamentals", *Plenum Press*, New York, 1983, by G. Walker.

"Extremely Large Heat Capacities between 4 and 10K", *Cryogenics*, vol. 15, (1975), by Buschow et al., pp. 261–264.

"New Magnetic Material R3T System with Extremely Large Heat Capacities Used as Heat Regenerators", *Adv. Cryogenic Eng.*, vol. 35, (1990), by Sahashi et al., pp. 1175–1182.

"High Efficient Two–Stage GM Refrigerator with Magnetic Material in Liquid Helium Temperature Region", *Adv. Cryogenic Eng.*, vol. 35, (1990), by Kuriyama et al., pp. 1261–1269.

K. A. Gschneidner, Jr., "Systematics of the Intra–Rare–Earth Binary Alloy Systems", *J. Less–Common Metals* , 114 pp. 29–42, (1985).

C. Y. Ho, R. W. Powell and P. E. Liley, "Thermal Conductivity of the Elements: A comprehensive Review", *J. Phys. Chem. Ref. Data*, 3, Supplement No. 1, pp. I258–I262 (Dy); I263–I267 (Er); I274–I278 and I398–411 (Pb); (1974).

Anonymous, "Thermal Conductivity of Selected Commercial Alloys", p. 492 in American Institute of Physics Handbook, 2nd Ed. D. E. Gray, Ed. McGraw–Hill, New York (1963).

T. E. Scott, "Elastic and Mechanical Properties", vol. 1, pp. 591–705 in Handbook on Physics and Chemistry of Rare Earths, K.A. Gschneidner Jr. and L.Eyring, Eds. North–Holland/Elsevier, Amsterdam (1978).

Anonymous, P. 217 (Bronze) and p. 550 (Pb), *Properties and Selection: Nonferrous Alloys and Special–Purpose Materials*, *Metals Handbook*, 10th ed., vol. 2 ASM Intern., Materials Park, Oh (1990).

Anonymous, p. 855, Properties and Selection: Irons, Steels, and High–Performance Alloys, *Metal Handbook*, 10th ed., vol. 1, ASM Intern., Materials Park, OH (1990).

* cited by examiner

*Primary Examiner*—William Doerrler

(57) ABSTRACT

A cryocooler with a regenerator comprising one or more regenerator components, which are ductile and oxidation resistant, including a rare earth metal, an alloy of two or more rare earth metals, an alloy of a rare earth metal with a non-rare earth metal, and an alloy of a rare earth metal with at least one interstitial element.

28 Claims, 41 Drawing Sheets

DUCTILE MAGNETIC REGENERATOR ALLOYS FOR CLOSED CYCLE CRYOCOOLERS

FIELD OF THE INVENTION

The present invention relates to ductile magnetic regenerator materials for cryocoolers and, more particularly, to magnetic regenerators to enhance cooling power and efficiency of closed cycle cryocoolers operating from approximately 300 K to approximately 10 K.

BACKGROUND OF THE INVENTION

Regenerators are an integral part of cryocoolers to reach low temperatures between 4 K and 20 K (approximately 270 to 250 K below room temperature) regardless of the refrigeration technique employed; e.g., regardless of whether the known Gifford-McMahon, Stirling, pulse tube, etc. cooling technique is employed. A two stage Gifford-McMahon cycle cryocooler or refrigerator used to reach extremely low temperatures, such as approximately 10 K, without a liquid refrigerant is discussed in U.S. Pat. No. 5 186 765. For discussion of other cryocoolers, see books entitled "Cryogenic Heat Exchangers", Plenum Press, New York, 1997, by R. A. Ackerman and entitled "Cryocoolers Part 1: Fundamentals", Plenum Press, New York 1983 by G. Walker.

One important property of a highly effective regenerator is that the regenerator material should have a large volumetric heat capacity. Most commercial regenerators today employ bronze or stainless steel screens or spheres to cool down to approximately 100 K, and lead (Pb) spheres to cool below 100 K, with 10 K being the no heat load low temperature limit because the heat capacity of lead becomes extremely low at that temperature. Sometimes a combination of bronze or stainless steel and lead are used for cooling below 50 K with a layered regenerator bed for a single stage refrigerator. Or, a two stage refrigerator is used with a bronze alloy and stainless steel materials used in the high temperature stage and lead (Pb) used in the low temperature stage as a result of the heat capacity of lead not decreasing as quickly as that of the other materials below 100 K. Above 100 K, most metallic, non-magnetic materials have the same molar heat capacity, reaching the DuLong-Petit limit of 3R, where R=8.314 J/mol K is the universal gas constant. In general, the higher the heat capacity of the regenerator bed material, the greater the cooling power of a cryocooler, all other parameters being equal.

The potential use of lanthanide intermetallic compounds, which exhibit low magnetic ordering temperatures (e.g. less than 10 K), as cryogenic magnetic regenerator materials (refrigerant or cold accumulating materials) was pointed out nearly 25 years ago by Buschow et al. in an article entitled "Extremely Large Heat Capacities between 4 and 10 K, *Cryogenics,* vol. 15, (1975), pages 261–264. However, a practical lanthanide regenerator material was not developed and put into use until about 15 years later when the use of $Er_3Ni$ (an intermetallic compound) as a low temperature stage regenerator material in a two-stage Gifford-McMahon cryocooler was proposed by Sahashi et al. in "New Magnetic Material $R_3T$ System with Extremely Large Heat Capacities Used as Heat Regenerators", *Adv. Cryogenic Eng.,* vol. 35, (1990), pages 1175–1182 and by Kuriyama et al. in "High Efficient Two-Stage GM Refrigerator with Magnetic Material in Liquid Helium Temperature Region", *Adv. Cryogenic Eng.,* vol. 35, (1990), pages 1261–1269.

These articles proposed the replacement of the lead (Pb) lower temperature stage regenerator material with $Er_3Ni$ intermetallic compound material. Replacement of the lead lower stage regenerator material with $Er_3Ni$ material (an intermetallic compound) permitted improved cooling to approximately 4.2 K instead of the approximately 10 K achievable with the previously used lead lower stage regenerator material with a reasonable refrigeration capacity at the lowest temperature. This improvement in cooling (i.e. to approximately 4.2 K) is attributable to the significantly higher heat capacity of $Er_3Ni$ than lead below 25 K (the heat capacity of lead becomes negligible below 10 K).

The Gschneidner and Pecharsky U.S. Pat. No. 5,537,826 issued Jul. 23, 1996, describes an improved regenerator for the low temperature stage (e.g. below 20 K) of a two stage Gifford-McMahon cryocooler. The patented regenerator comprises intermetallic compounds $Er_6Ni_2Pb$, $Er_6Ni_2(Sn_xGa_{1-x})$, where x is greater than 0 and less than 1, and $Er_6Ni_2Sn$ as a regenerator component.

An object of the present invention is to reduce the cost and to improve the reliability, efficiency and increase the cooling power of a cryocooler at both the low and high temperature ranges or stages, for example, from about 10 K up to 100 K, more generally from approximately 300 K to approximately 10OK.

Another object of the present invention is to utilize ductile magnetic rare earth (lanthanide) based solid solution alloys, which can be easily fabricated into tough, non-brittle, corrosion resistant spherical powders, or thin sheets, or thin wires, or porous monolithic forms (such as cartridges), as the regenerator material.

Another object of the present invention is to provide a cryocooler with a regenerator having significantly higher heat capacity than the aforementioned previously used regenerator materials and combinations thereof, such as bronze, stainless steel, and lead.

SUMMARY OF THE INVENTION

The present invention provides in one embodiment a cryocooler having improved cooling at both the low and high temperature ranges or stages of operation, for example, at 10 K up to 100 K and more generally from approximately 10 K to approximately 300 K, by using a passive magnetic regenerator comprising one or more regenerator components including a magnetic rare earth (lanthanide) metal and solid solution alloy thereof with one another, a non-rare earth metal, and/or an interstitial element. To reach temperatures below 50–100 K, the invention envisions using two or more of the regenerator components in a particular embodiment. A solid state solution alloy is a random statistical mixture of two or more metals (and occasionally a metal matrix [solvent] with an interstitial element solute [e.g. H, B, C, N, O]) which occupy the crystalline sites of a solid. This is in contrast to an intermetallic compound in which the component atoms (two or more) occupy specific lattice sites in the crystal in an ordered arrangement. Thermodynamically, a solid solution alloy belongs to the same phase region as the solvent in contrast to an intermetallic compound, which is a different phase from that of both the solvent and solute. The magnetic regenerator component(s) may comprise one or more rare earth (lanthanide) metals including Gd, Tb, Dy, Ho, Er, Tm, and in particular alloys thereof with other rare earth metals (Sc, Y, La, Ce, Pr, Nd, Sm, Eu, Gd, Tb, Dy, Ho, Er, Tm, Yb, and Lu), with non-rare earth metals which are at least partially soluble in the solid state of the aforementioned metals (for example, Mg, Ti, Zr, Hf, Th), and with interstitial elements which are also at least partially soluble in the aforementioned metals (for example, H, B, C, N, O, F). The rare earth (lanthanide) metals and alloys can be used in the form of a layered regenerator bed comprising different metal and/or alloy layers in the form of wires, foils, jelly rolls, monolithic porous cartridges, powders (spherical and non-spherical), or as a particulate bed comprising a different metal particulate regions. The regenerator bed can include other metals such as bronze, stainless steel, lead, etc. to tailor regenerative properties of the regenerator bed. The magnetic regenerator is advantageous in that it can be tailored to improve cooling power and efficiency of the cryocooler in the above temperature ranges or stages of operation from approximately 300 K to approximately 10 K.

Moreover, since the regenerator rare earth metals and their solid solution alloys with other rare earth metals, non-rare earth metals and interstitial elements are relatively ductile as compared, for example, to brittle intermetallic compounds, the regenerator layers or particulates will not attrite or comminute and pulverize in use of the regenerator. Further, the rare earth metals and their solid solution alloys can be readily fabricated into wires, sheets, or spheres or porous monolithic form for use as regenerator components.

The advantage of the materials embodied in this invention, is that they can be easily and economically fabricated into a form which allows the design engineer to chose from spherical particles, wire mesh, flat plates, jelly rolls, porous monolithic forms, etc. to construct the regenerator. Furthermore, since these materials are tough, they will not deform (as the soft lead spheres do) or comminute or decrepitate and pulverize (as the brittle intermetallic compounds do) under the cyclic high pressure gas flows used in present day cryocoolers. Furthermore, the embodied materials are oxidation resistant and do not become fine oxide powders when exposed to air as does Nd metal spheres or foil, which are used as regenerator materials in cryocoolers operating at 10 K or less.

The foregoing and other objects, features and advantages of the present invention will become apparent from the following more detailed description taken with the following drawings.

DESCRIPTION OF THE DRAWINGS

FIG. 5*b* also shows the volumetric heat capacity of $Er_3Ni$ (an intermetallic compound).

FIG. 13*a* is a graph of transition temperatures versus Ce/La concentration of La—Er and Ce—Er solid solution alloys, while

FIG. 17 also shows the volumetric heat capacity of the $Nd_{60}Er_{40}$ solid solution alloy.

DESCRIPTION OF THE INVENTION

Figure 2A:
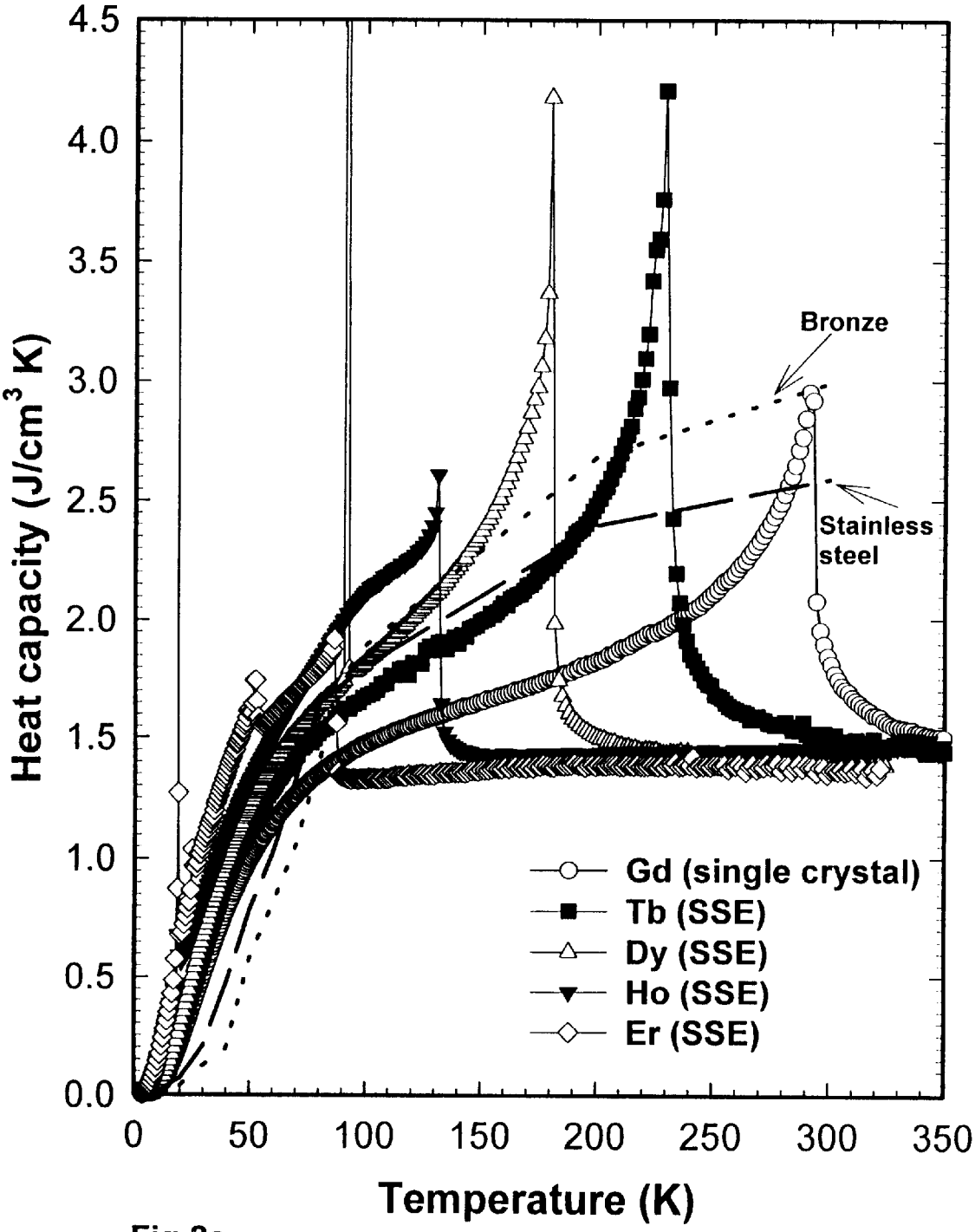
FIG. 2*a* is a composite graph of the volumetric heat capacities from 3.5 to 350 K of the pure rare earth (lanthanide) metals Gd, Tb, Dy, Ho and Er along with that of bronze and stainless steel (e.g. type 304 or 316 stainless steel) . (SSE in FIGS. 2*a* and 2*b* means Solid State Electrolysis purified).
Figure 3A:
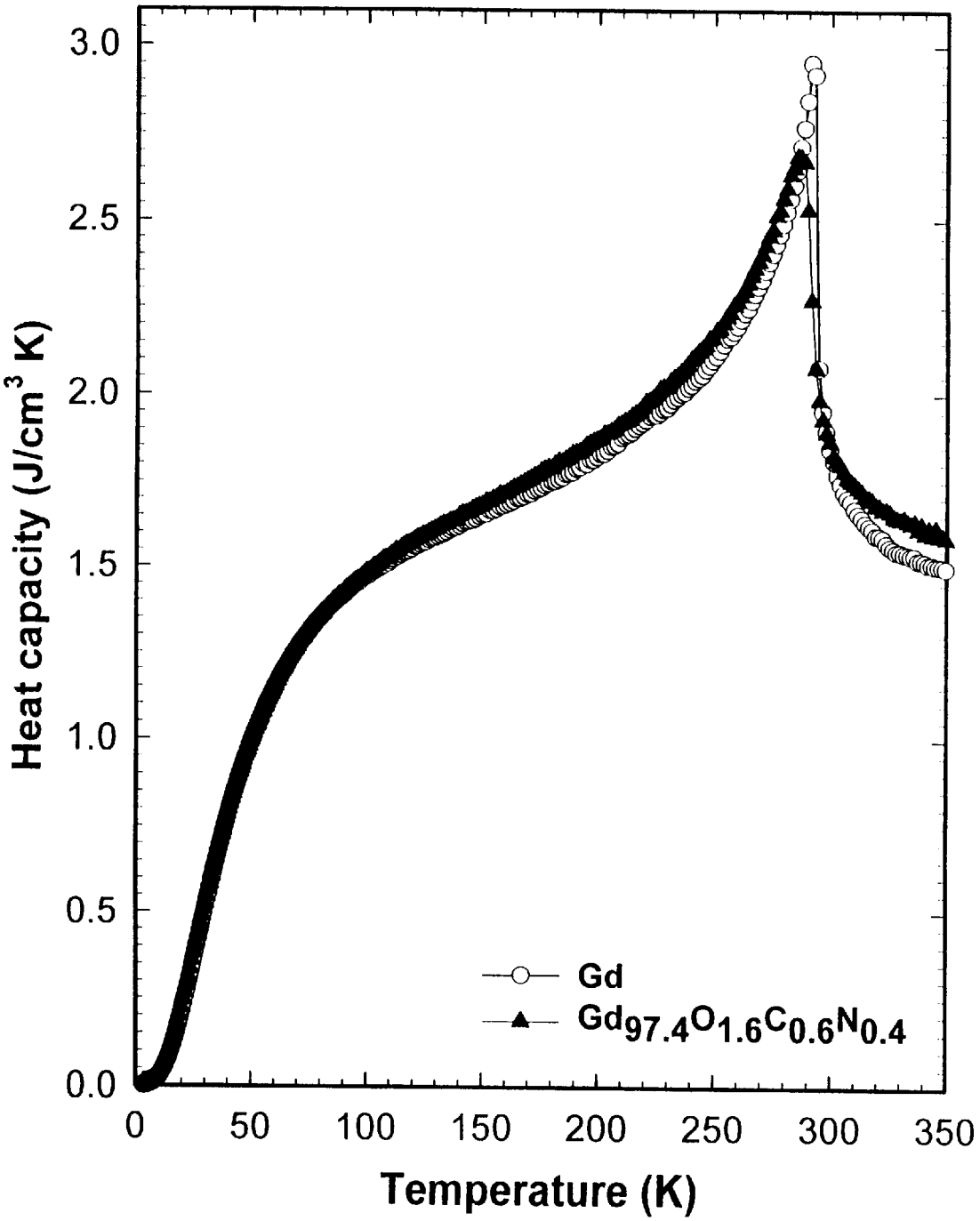
FIGS. 3*a*, 3*b*, and 3*c* are graphs showing the effect of inclusion of interstitial elements in certain rare earth metal solid solution alloys on their heat capacity over the temperature ranges set forth.
Figure 3B:
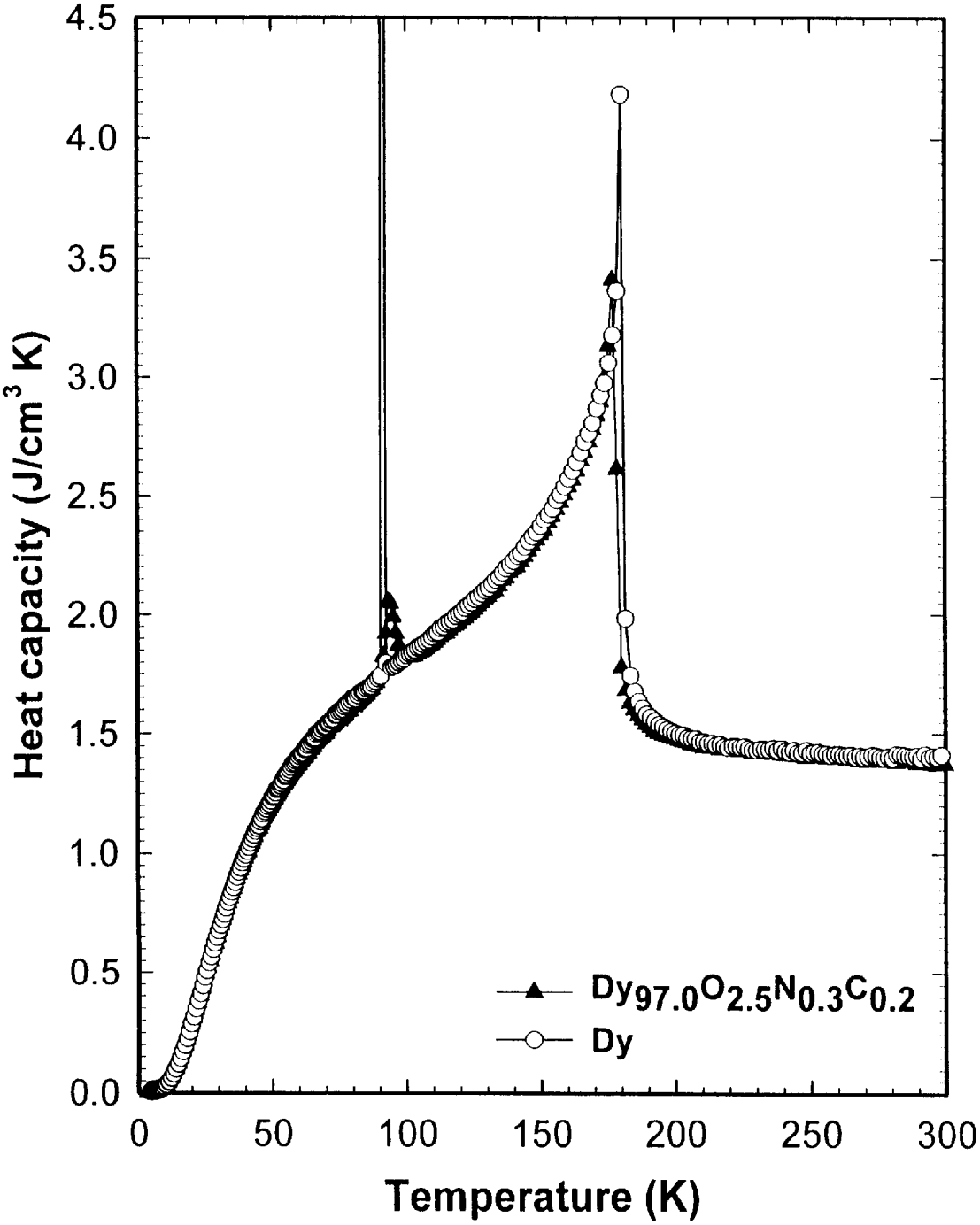
Figure 3C:
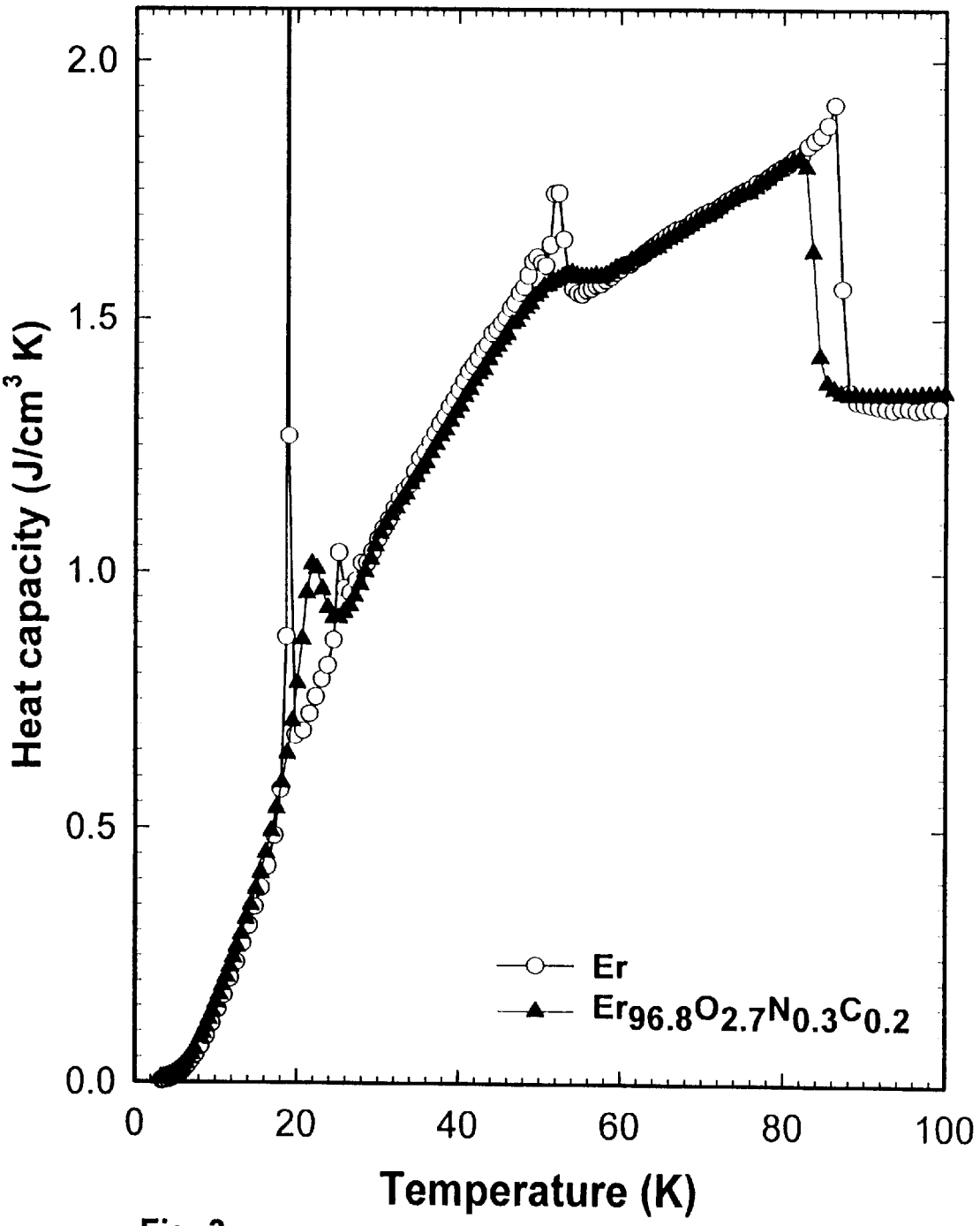

Refer to FIG. 2*a*, it is seen that near the magnetic ordering temperatures, the pure rare earth metals have higher volumetric heat capacities than those of bronze and stainless steel. By appropriate solid solution alloying various combinations of the heavy lanthanide metals (Gd, Tb, Dy, Ho, Tm, and Er) with each other, one would be able to fill in the gaps (temperature ranges) where the volumetric heat capacity of bronze is larger than that of any of the pure metals (i.e. 180–210 K, and 235–290 K). This (the filling of the gaps by proper alloying) is discussed below. The volumetric heat capacities of these rare earth metals below 100 K are shown in more detail in FIG. 2*b* along with lead, stainless steel and bronze. It is seen that below 60 K, where lead has a higher heat capacity than either stainless steel or bronze, four of the rare earth metals are better than lead for a significant temperature range: for Tb 55–350 K, for Dy 45–350 K, for Ho 35–350 K and Er 18–90 K (and the same as lead from 5–18 K, and 90–200 K), (note: the volumetric heat capacity of lead in the upper temperature regions above 100 K are not shown in FIG. 2*a*, but the heat capacities of the rare earth metals are indeed greater than that of lead for the quoted temperature ranges). Thus for the temperatures below 80 K, Er is the best candidate cryocooler regenerator material, when compared to those in common use to reach 10 K, i.e.

combinations of lead, stainless steel and bronze. Finally, we note that the heat capacities very near the magnetic ordering temperatures are quite large over narrow temperature range for Tb at 230 K and for Dy at 180 K, and extremely large at the first order transitions of Dy at 91 K and of Er at 19 K. The high heat capacities, although very attractive, are not particularly useful as cryocooler regenerators because they only occur at a narrow temperature range of about 2 K for the latter two and ~5 K for the former two. One can improve their cryocooler regenerator capabilities by alloying with the interstitial elements, such as H, B, C, N, and O, which smear out the first order phase transition by straining the crystal lattice and lower the large heat capacity values at the transition temperature and broaden the transition over a wider temperature range, see FIGS. 3*a, b,* and *c*. Three typical examples showing the effect of adding interstitial alloying agents on the volumetric heat capacities are shown in FIGS. 3*a, b,* and *c*. FIG. 3*a* shows that adding oxygen, carbon and nitrogen to essentially pure Gd to form a quaternary solid solution alloy $Gd_{97.4}O_{1.6}C_{0.6}N_{0.4}$ [where the amount of each alloying element is set forth in atomic %, e.g. Gd is 97.4 atomic %, O is 1.6 atomic %, C is 0.6 atomic %, and so on] lowers the heat capacity peak of Gd by about 20% and increases the width by about 10 K. Other solid solution alloys pursuant to the invention are described hereafter using similar atomic formulae, the alloying elements being set forth in atomic %. FIGS. 3*b* and 3*c* illustrate the large effect interstitial alloying agents have on the first order transitions of Dy (91 K, FIG. 3*b*) and Er (19 K, FIG. 3*c*). In both cases the extremely large values of the volumetric heat capacity are greatly reduced, and the peaks are both broader and shifted to slightly higher temperatures. The high temperature second order peaks (180 K-Dy, 85 K-Er) are reduced by 20% in Dy and 5% in Er, and shifted to lower temperatures (FIGS. 3*b* and 3*c*, respectively). Furthermore, the spin-slip magnetic transitions in Er at 22 and 50 K are essentially eliminated by alloying (FIG. 3*b*). These changes are beneficial in that they improve the regenerator properties of the pure rare earth elements by eliminating or reducing the high heat capacity spikes and shifting the entropy associated with the peaks over a wider, and thus more useful, temperature range.

Interstitial solid solution alloyed Gd, Dy, and Er such as $Gd_{97.4}O_{1.6}C_{0.6}N_{0.4}$, $Dy_{97.0}O_{2.5}N_{0.3}C_{0.2}$, and $Er_{96.8}O_{2.7}N_{0.3}C_{0.2}$ are available from a variety of commercial companies in the US and in other countries, e.g. Rhodia in Pheonix, Ariz.; Arris International in West Bloomfield, Mich.; and Tianjiso International Trading Company, in Burlingame, Calif. For commercially available alloys, the rare earth element content can vary from 99 to 95 atomic %, the oxygen content from 0.5 to 5.0 atomic %, the carbon content from 0.1 to 3.0 atomic %, and the nitrogen content from 0.1 to 3.0 atomic %. The Er alloys described below were made using the latter alloy, all had similar O, N, and C levels, which do not change significantly when the starting alloy is alloyed with other elements, especially other rare earth metals since they have similar impurity levels.

Since present day cryocoolers have three distinct temperature spans, either as a single stage cooler with a layered regenerator bed, or as a two (and even three) stage cooler which may or may not have layered regenerator beds in the various stages, we will discuss the utilization of these magnetic rare earth alloys in two of the three temperature regimes: high temperature (60–300 K), intermediate temperature (10–60 K) and low temperature (less than 4 to 10 K). The two temperature regimes of interest are the high and intermediate temperature ones.

Figure 4A:
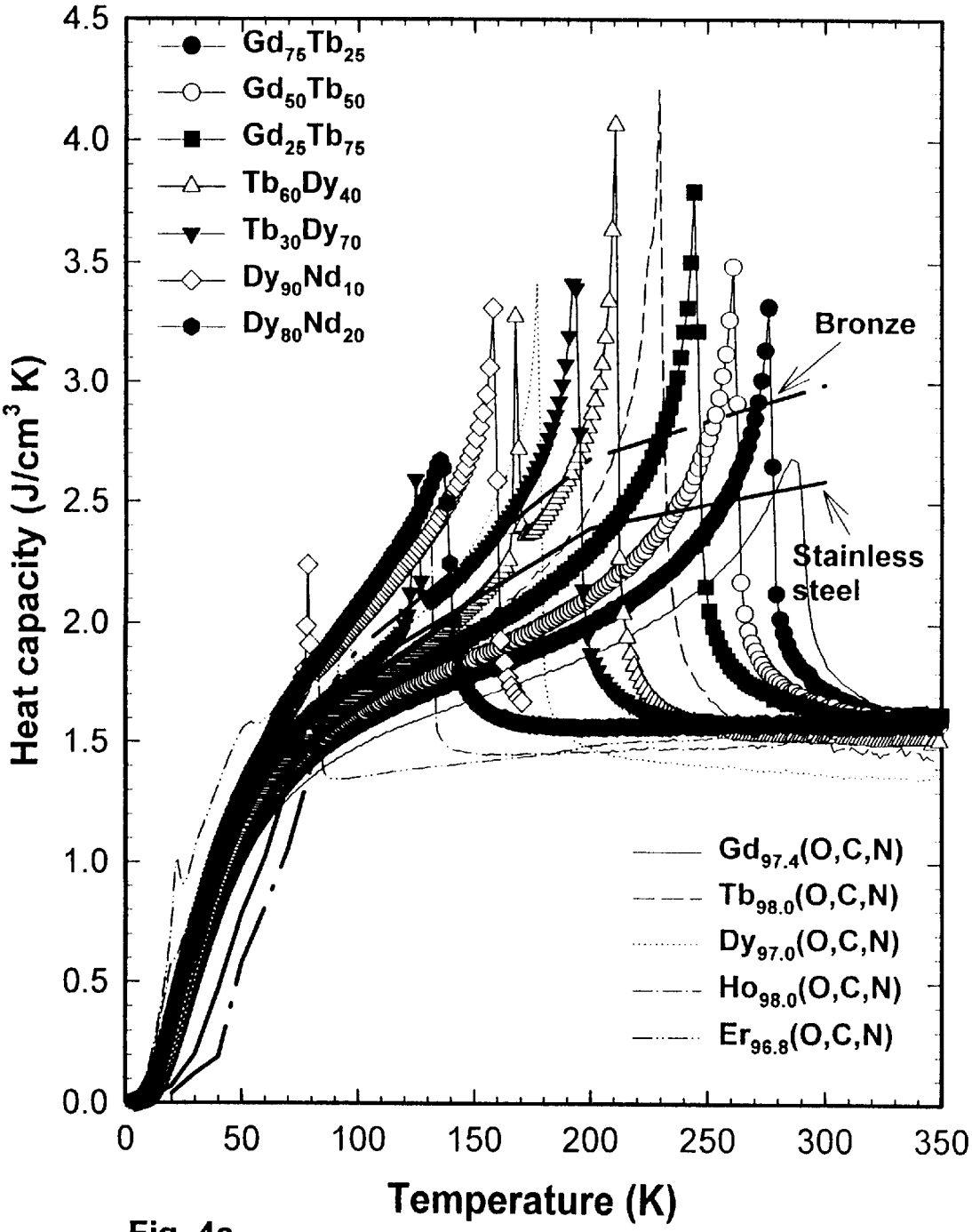
FIGS. 4*a*, 4*b*, and 4*c* are composite graphs showing the volumetric heat capacities of certain rare earth metals and solid solution alloys and stainless steel and bronze over the temperature ranges set forth.
Figure 4B:
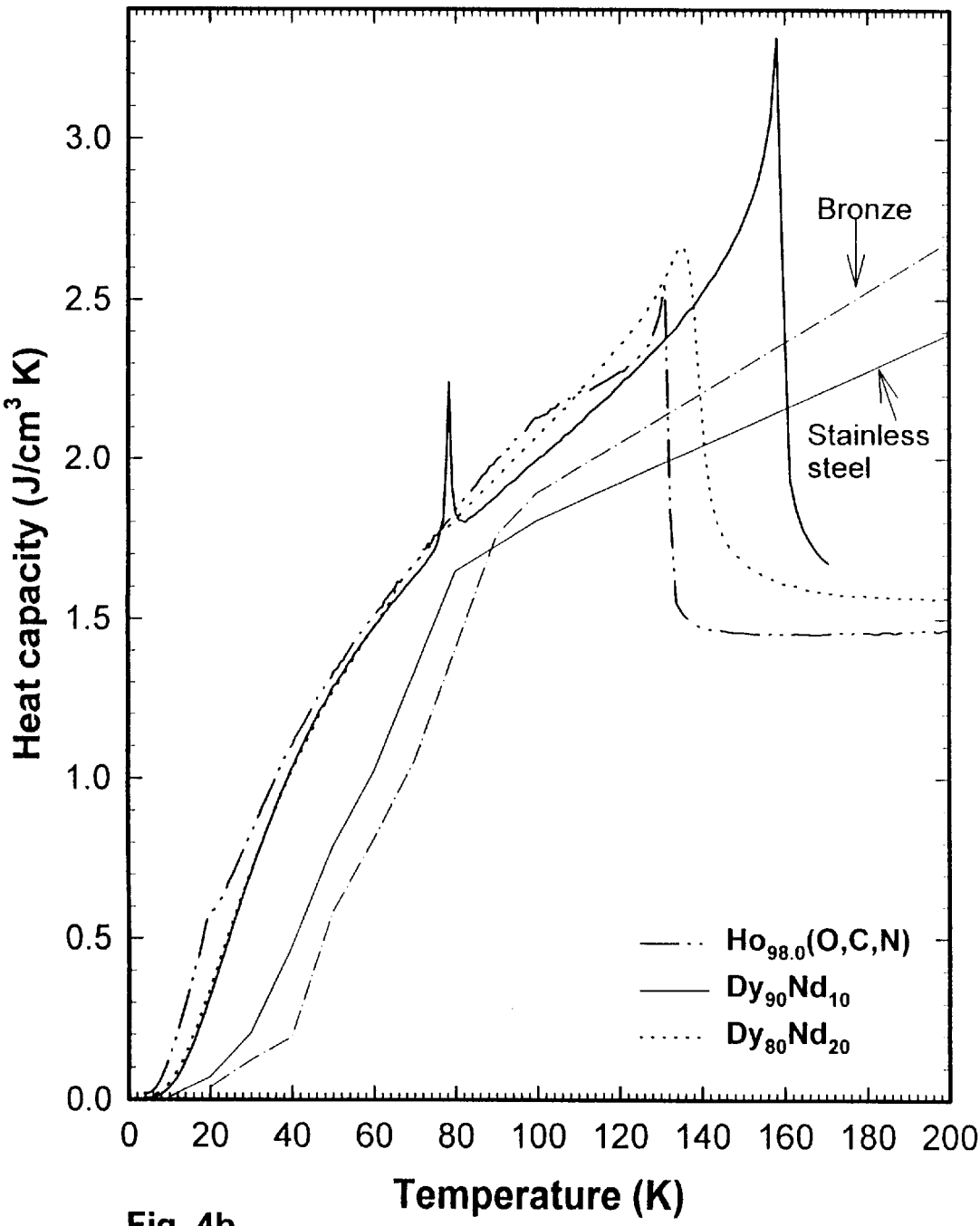
Figure 4C:
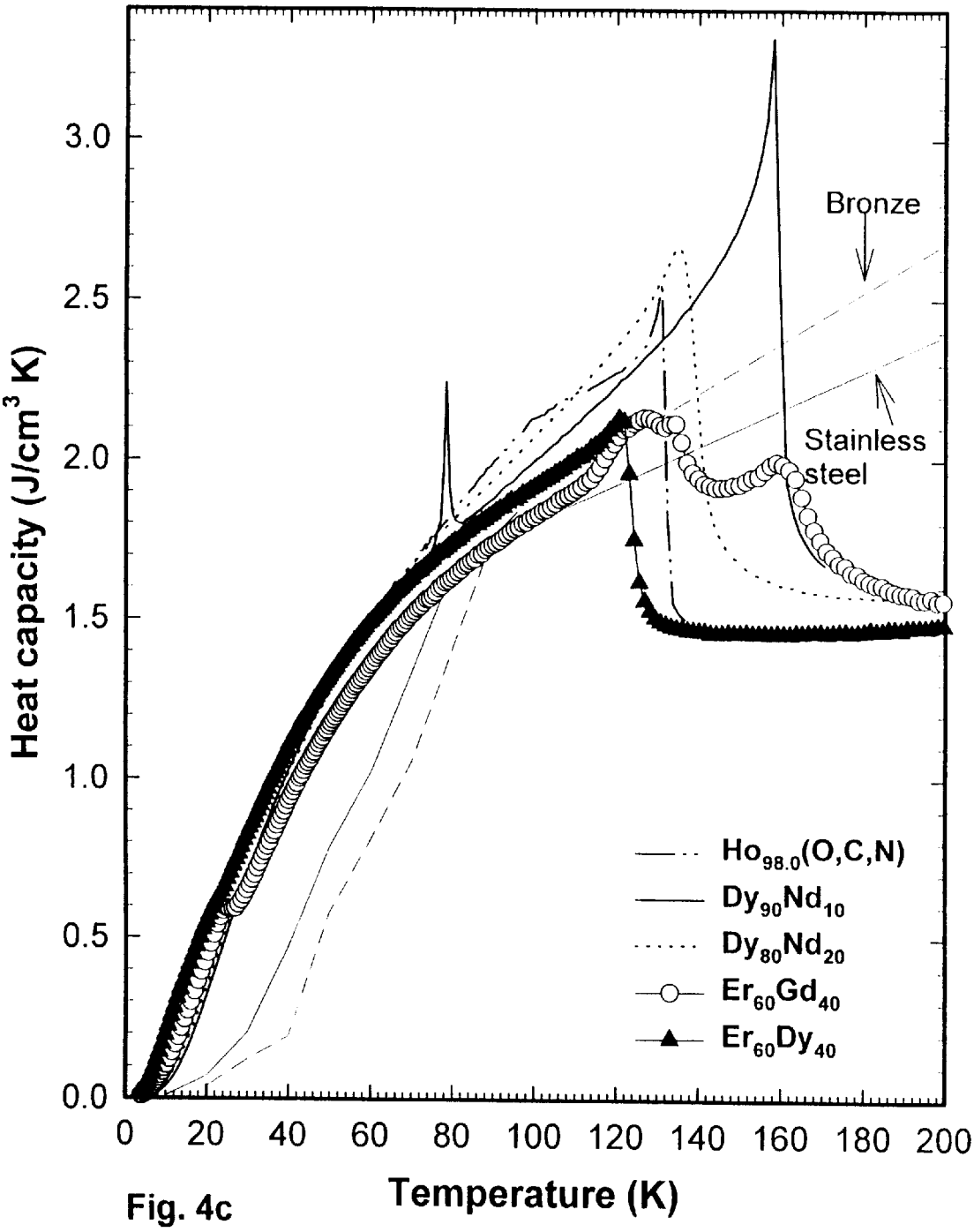

For high temperature regime, the main concern was to develop intra rare earth solid solution alloys which will primarily fill in the gaps (valleys) between the high heat capacity peaks shown in FIG. 2*a* over the 60 to 300 K temperature range; in particular, temperatures between 60 and 90 K, 90 and 130 K, 140 and 160 K, 180 and 210 K, and 230 and 295 K. Some examples of solid solution alloys which can be used to fill-in the gaps (see FIG. 4*a*) are: (1) $Ho_{98.0}$(O, C, N) and $Dy_{80}Nd_{20}$ which have the highest heat capacity between 60 and 130 K, and 60 and 140 K, respectively (see FIG. 4*b*), easil filling in the two lowest temperature gaps; (2) $Dy_{90}Nd_{10}$ works very well for the 140 to 160 K range (see FIG. 4*b*); (3) $Tb_{30}Dy_{70}$ is the best for the 180 to 200 K range, and $Tb_{60}Dy_{40}$ for the 200 to 215 K temperature region (FIG. 4*a*). Other solid solution alloys, which would work above 230 K, are shown in FIG. 4*a* are: (1) $Gd_{25}Tb_{75}$ with a maximum in the heat capacity at 245 K; (2) $Gd_{50}Tb_{50}$with a heat capacity maximum at 260 K; and (3) $Gd_{75}Tb_{25}$ with a maximum at 280 K. The first alloy would cover the gap between 230 and 250 K, the second eliminates the gap between 250 and 270 K, while the third alloy would be effective between 270 and 285 K. In FIG. 4*b* we show in more detail the overlapping heat capacities of $Ho_{98.0}$(O, C, N) and $Dy_{80}Nd_{20}$ solid solution alloys. The latter has two advantages over the former, the volumetric heat capacity of $Dy_{80}Nd_{20}$ is larger above 130 K and it costs significantly less than the $Ho_{98.0}$(O, C, N) material (note the heat capacities below 60 K do not matter, since there are better materials for the intermediate temperature cryocooler regenerators, see below). Shown in FIG. 4*c* are the heat capacities of $Er_{60}Dy_{40}$ and $Er60Gd_{40}$. Their heat capacities are in general less than those of the other three materials $Ho_{98.0}$(O, C, N), $Dy_{80}Nd_{20}$ and $Dy_{90}Nd_{10}$. It is seen from FIGS. 2*a*, 4*a* and 4*b* that the average volumetric heat capacity of the rare earth alloys is 10 to 20% larger than that of bronze from 60 to 280 K; and 20 to 30% from 100 to 300 K, and 10 to 20% from 60 to 100 K for stainless steel. Thus by forming a layered rare earth (lanthanide) regenerator bed, one can expect a significant increase in the regenerator performance over either the bronze or stainless steel regenerator from 60 to 300 K.

Figure 2B:
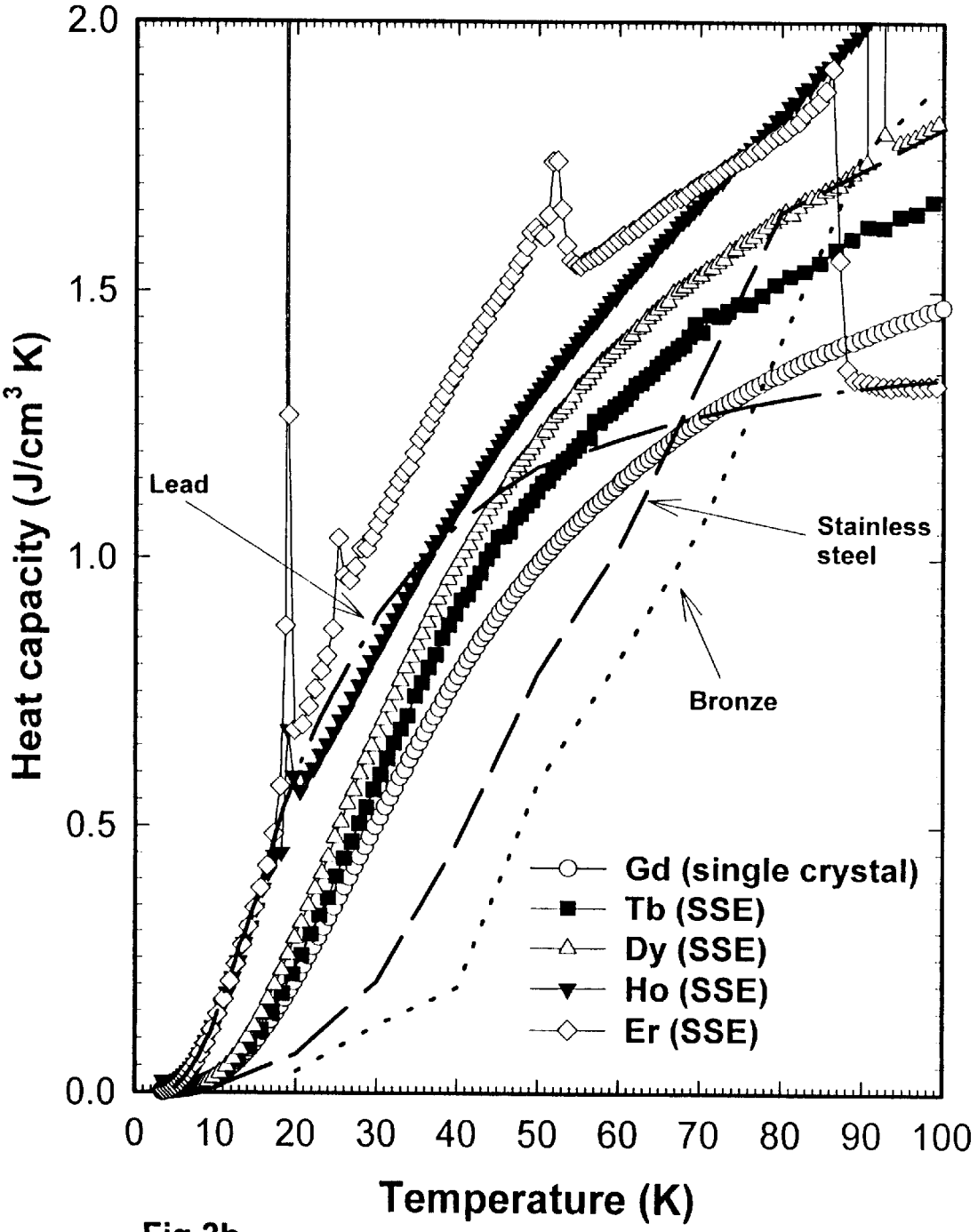
FIG. 2*b* is a composite graph of the volumetric heat capacities below 100 k of these same rare earth metals and lead, stainless steel, and bronze.
Figure 5A:
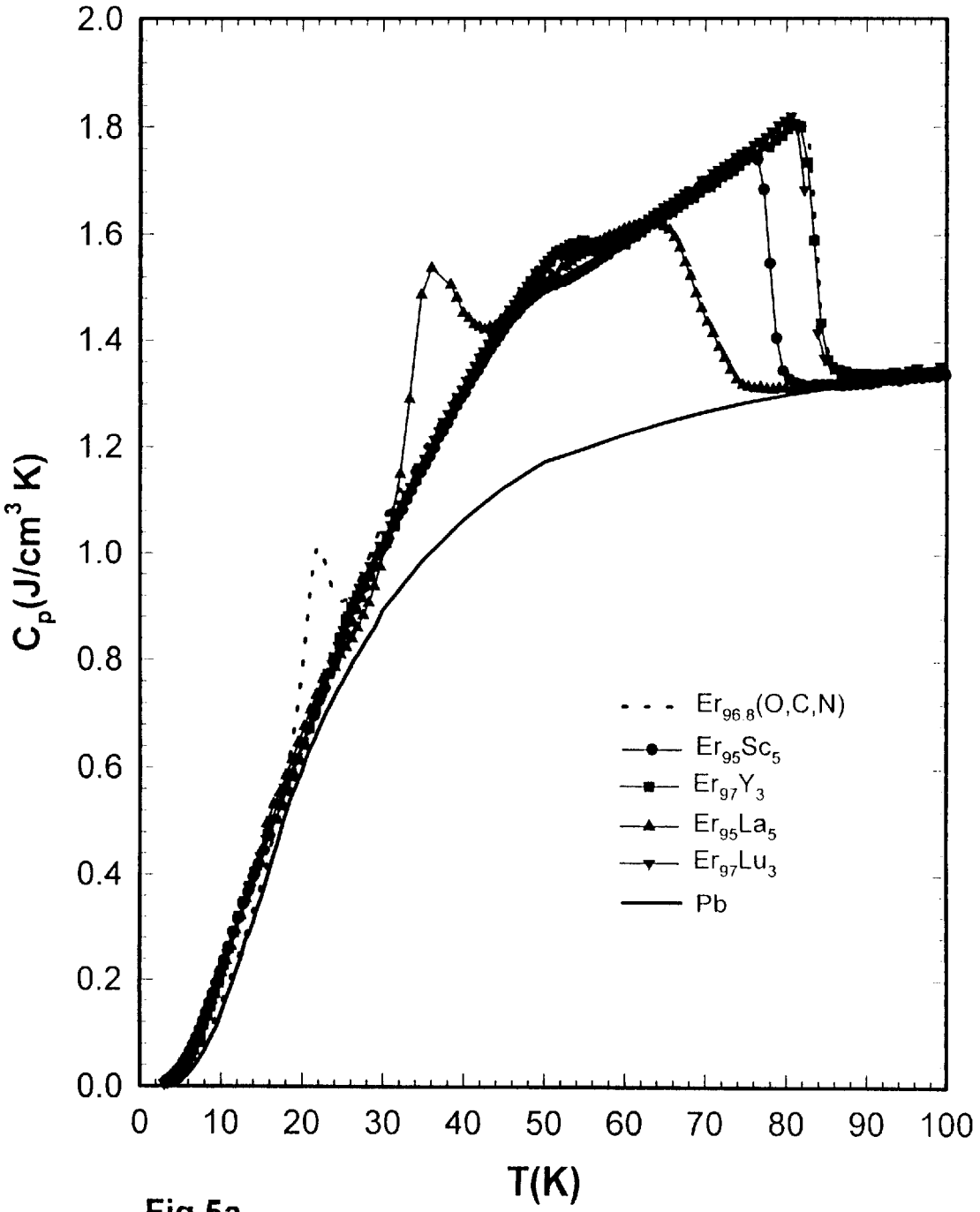
FIGS. 5*a* and 5*b* are graphs of volumetric heat capacities of the listed rare earth metal solid solution alloys and Pb from 0 to 100 K, FIG. 5*a*, and from 0 to 50 K, FIG. 5*b*.
Figure 5B:
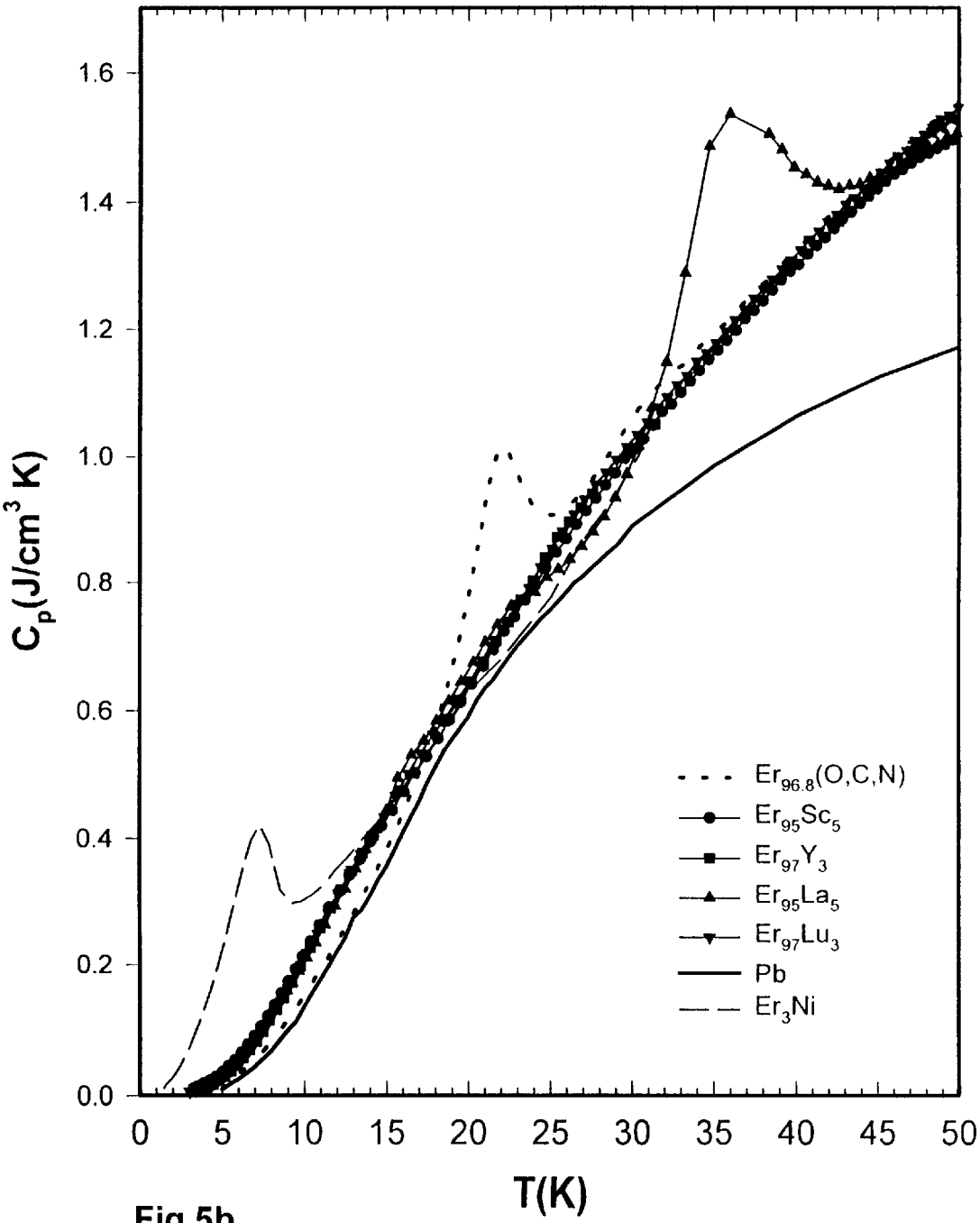
Figure 6:
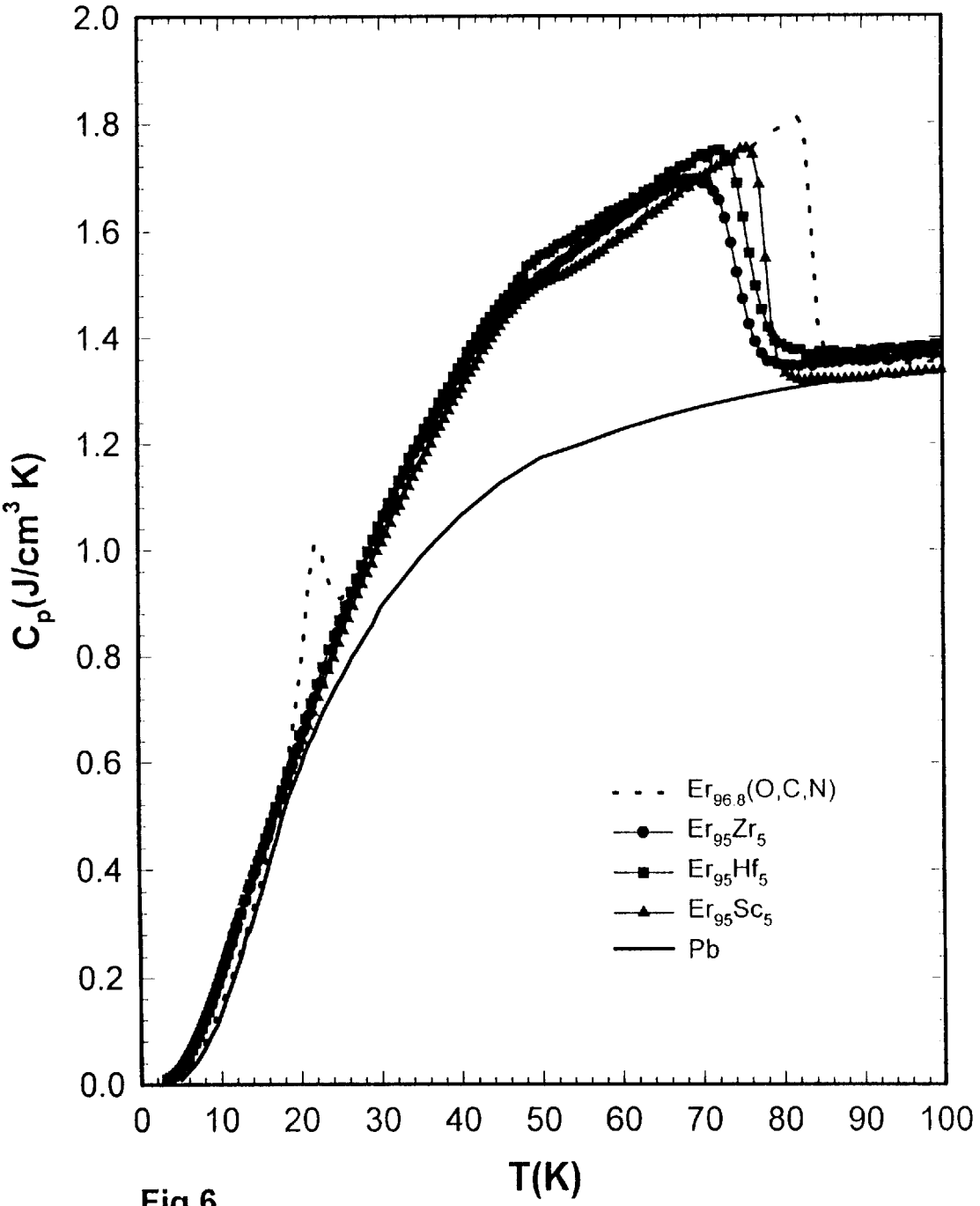
FIGS. 6, 7, 8, 9, 10, 11*a*, 11*b*, 12*a*, 12*b*, and 12*c* are graphs of volumetric heat capacities of the listed rare earth metal solid solution alloys and Pb over the temperature ranges set forth.

We now turn our attention to the intermediate temperature region, and as seen in FIG. 2*b*, pure erbium has the highest volumetric heat capacity between 18 and 70 K of any known material. Based on this fact a number of Er-based solid solution alloys have been studied with the idea of replacing lead as the intermediate temperature regenerator material. FIGS. 5*a* and 5*b* show the heat capacities of $Er_{95}Sc_5$, $Er_{97}Y_3$, $Er_{95}La_5$ and $Er_{97}Lu_3$ solid solution alloys along with those of $Er_{96.8}$(O, C, N) and Pb from 0 to 100 K (FIG. 5*a*) and from 0 to 50 K (FIG. 5*b*). Except for the $Er_{95}La_5$ solid solution alloy the general trend is to lower the 85 K transition and to wipe out the 20 K transition of $Er_{96.8}$(O, C, N) with no substantial improvement of the volumetric heat capacity at temperatures above 15 K, see FIG. 5*a*. But at low temperatures below 15 K, there is an increase of the heat capacities of all solid solution alloys over the baseline materials $Er_{96.8}$(O, C, N) and Pb by 25 and 35%, respectively, see FIG. 5*b*. The $Er_{95}La_5$ behaves much differently, the La addition significantly lowers the upper transition and shifts the lower peak from 20 to 35 K, giving rise to a significant increase in the heat capacity between 30 and 40 K over the $Er_{96.8}$(O, C, N). The volumetric heat capacities of $Er_{95}Zr_5$ and $Er_{95}Hf_5$ along with those of $Er_{95}Sc_5$ (which is repeated here for comparison purposes) and $Er_{96.8}$(O, C, N) and Pb are presented in FIG. 6. The $Er_{95}Zr_5$ and $Er_{95}Hf_5$ alloys behave much like the $Er_{95}Sc_5$, lowering the upper transition temperature and destroying the lower one, without much change in the heat capacity.

Figure 7:
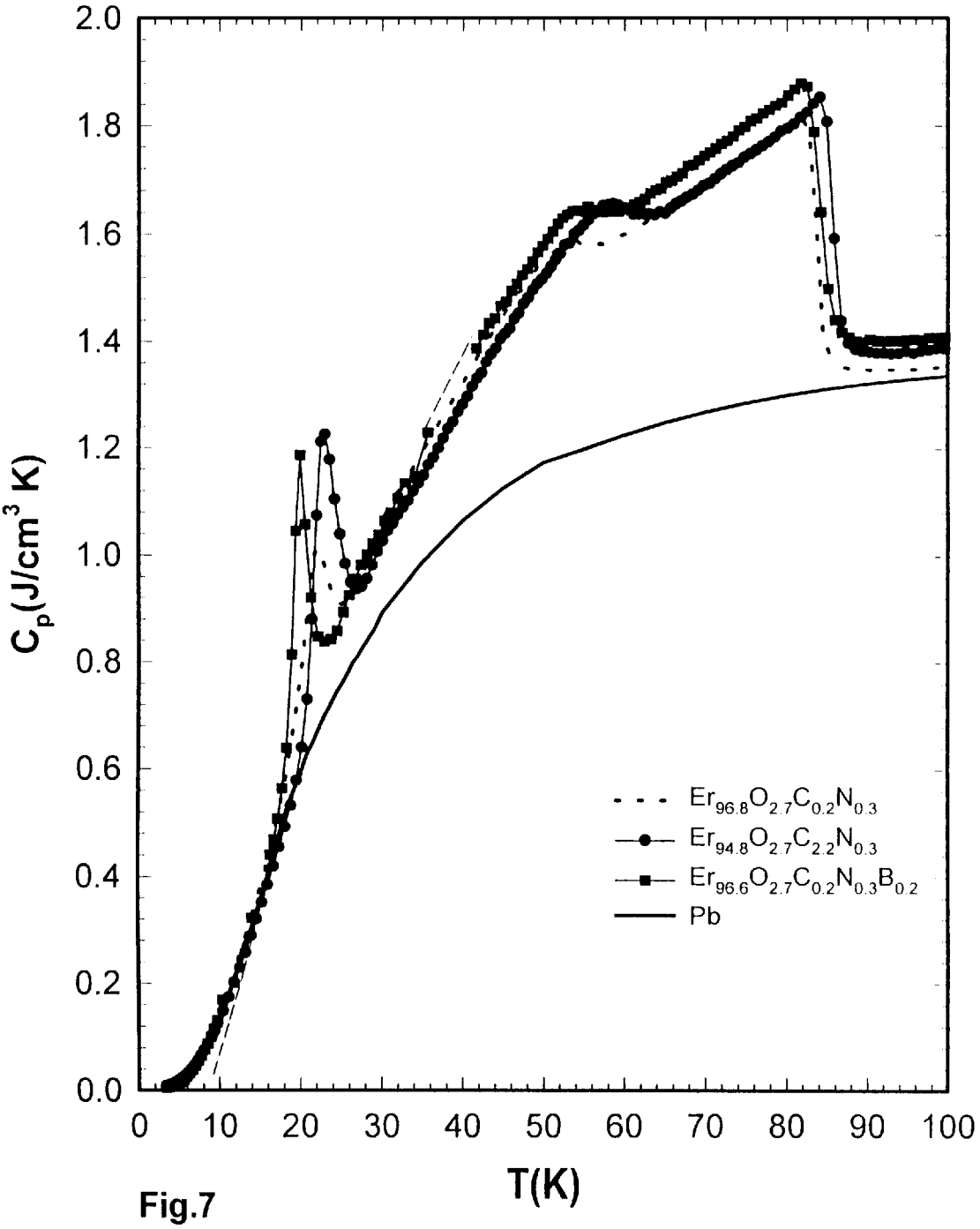

The influence of increasing the carbon content and also the addition of boron to the $Er_{96.8}$(O, C, N) base solid solution alloy is shown in FIG. 7. Both the addition of boron and extra carbon raises the 82 K transition of the $Er_{96.8}O_{2.7}C_{0.2}N_{0.3}$ by 1 and 2 K, respectively. Furthermore, the boron addition causes a slight increase in the volumetric heat capacity from 25 to 82 K, by as much as 3% from 53 to 82 K. Both the boron and carbon additions have a significant effect on the 21 K transition of $Er_{96.8}O_{2.7}C_{0.2}N_{0.3}$ alloy: both significantly increase the heat capacity at their respective transition temperatures by about 15%, and boron lowers the transition temperature, while the extra carbon raises this transition temperature.

Figure 8:
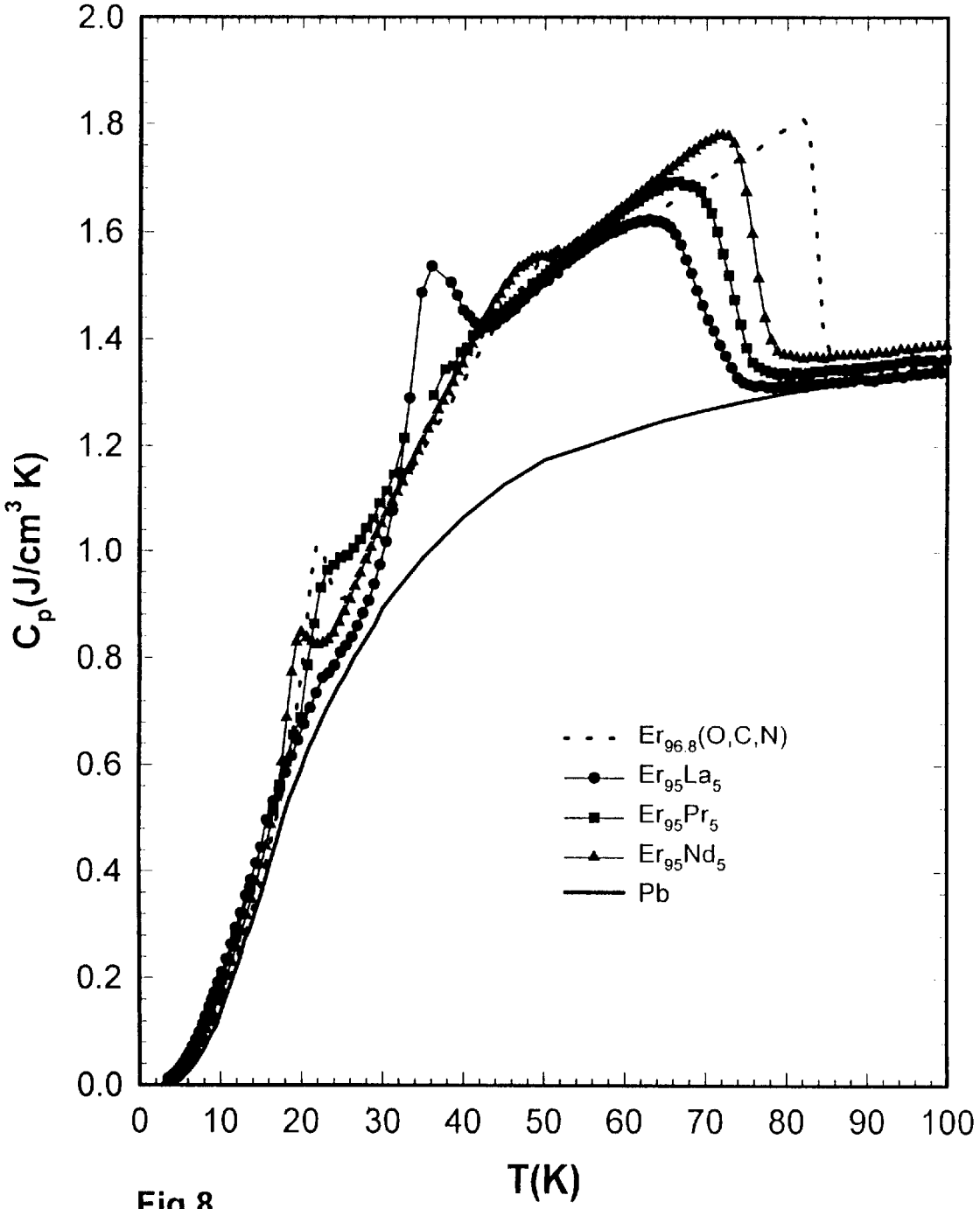
Figure 9:
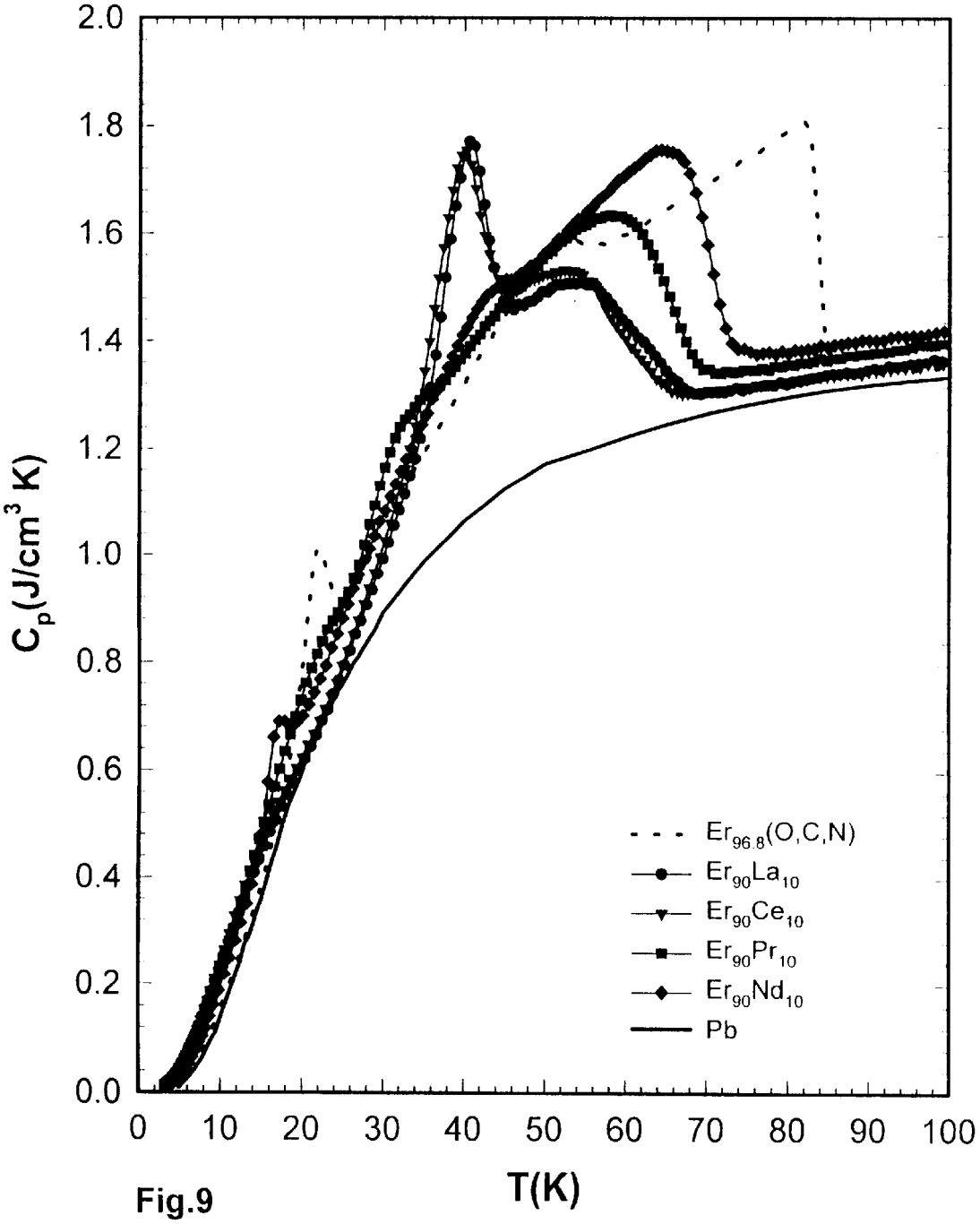
Figure 10:
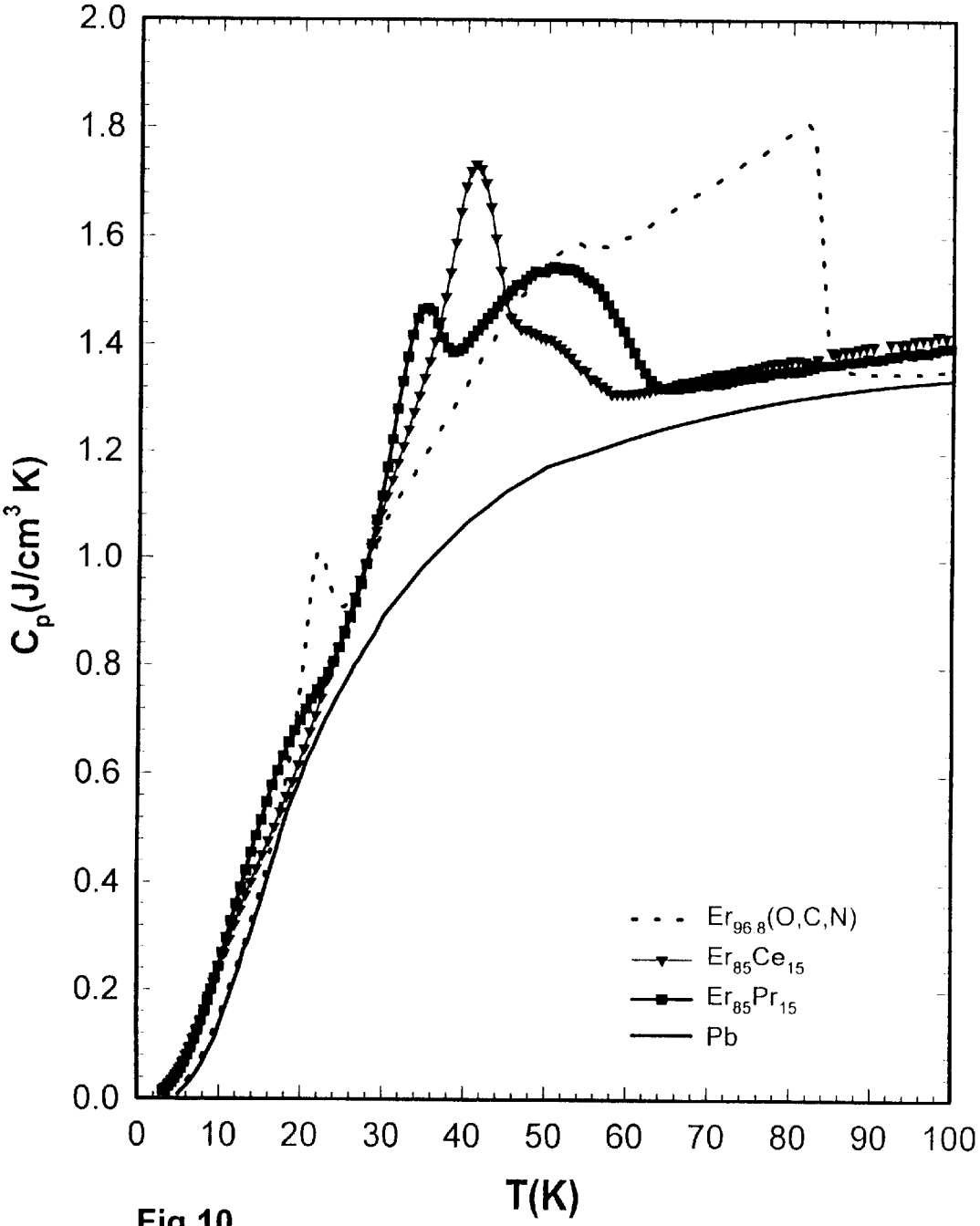
Figure 11A:
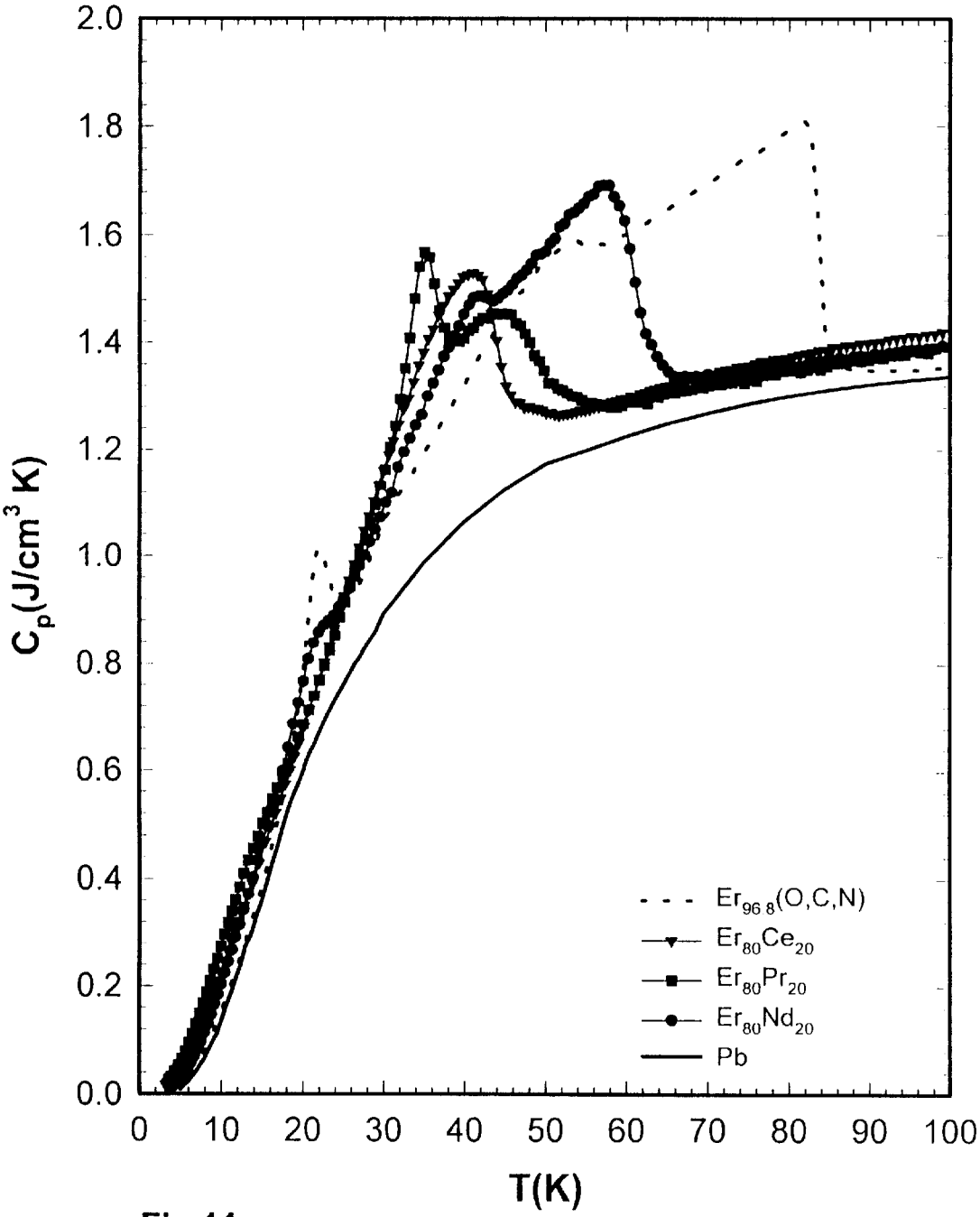
Figure 11B:
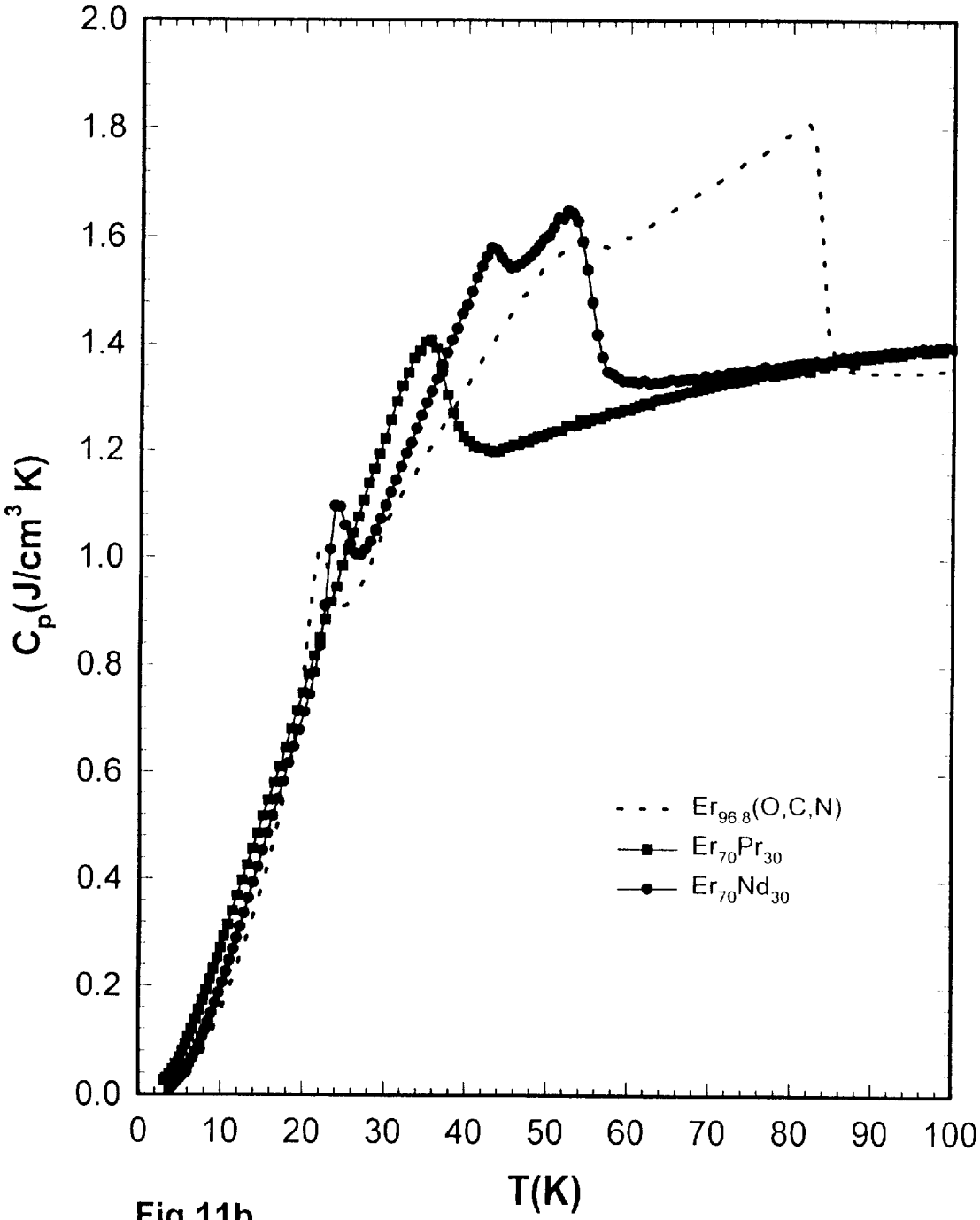
Figure 12A:
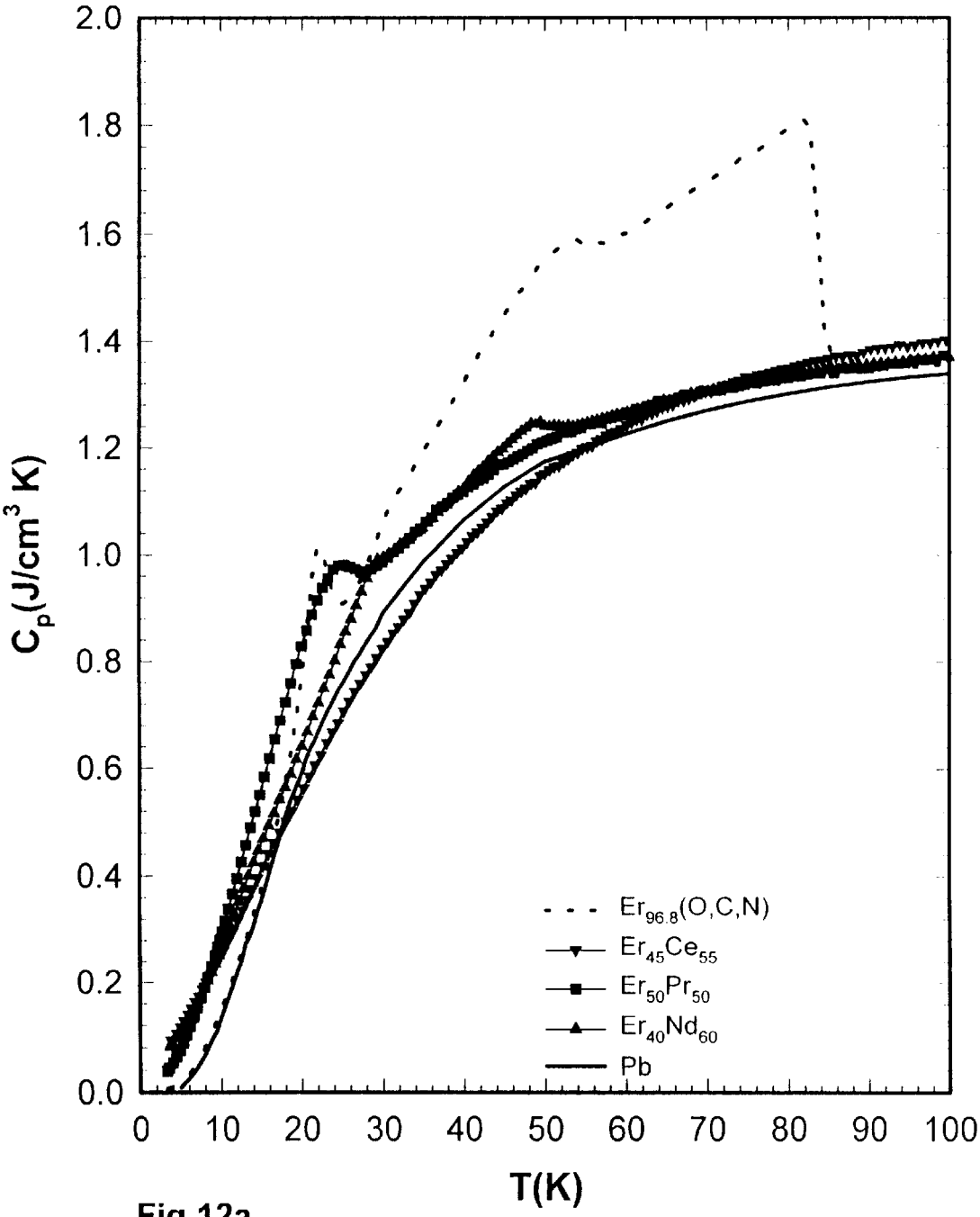
Figure 12B:
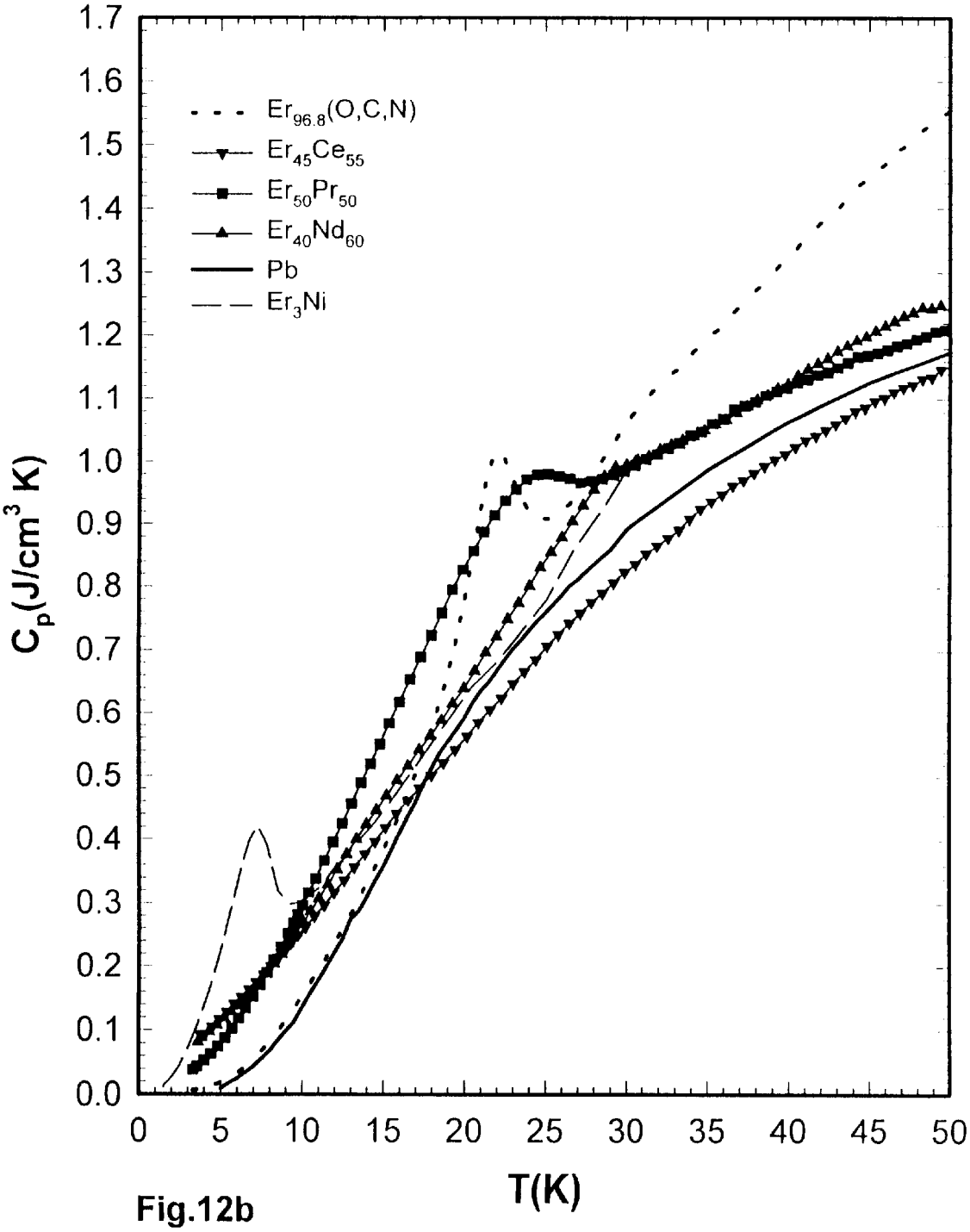
Figure 12C:
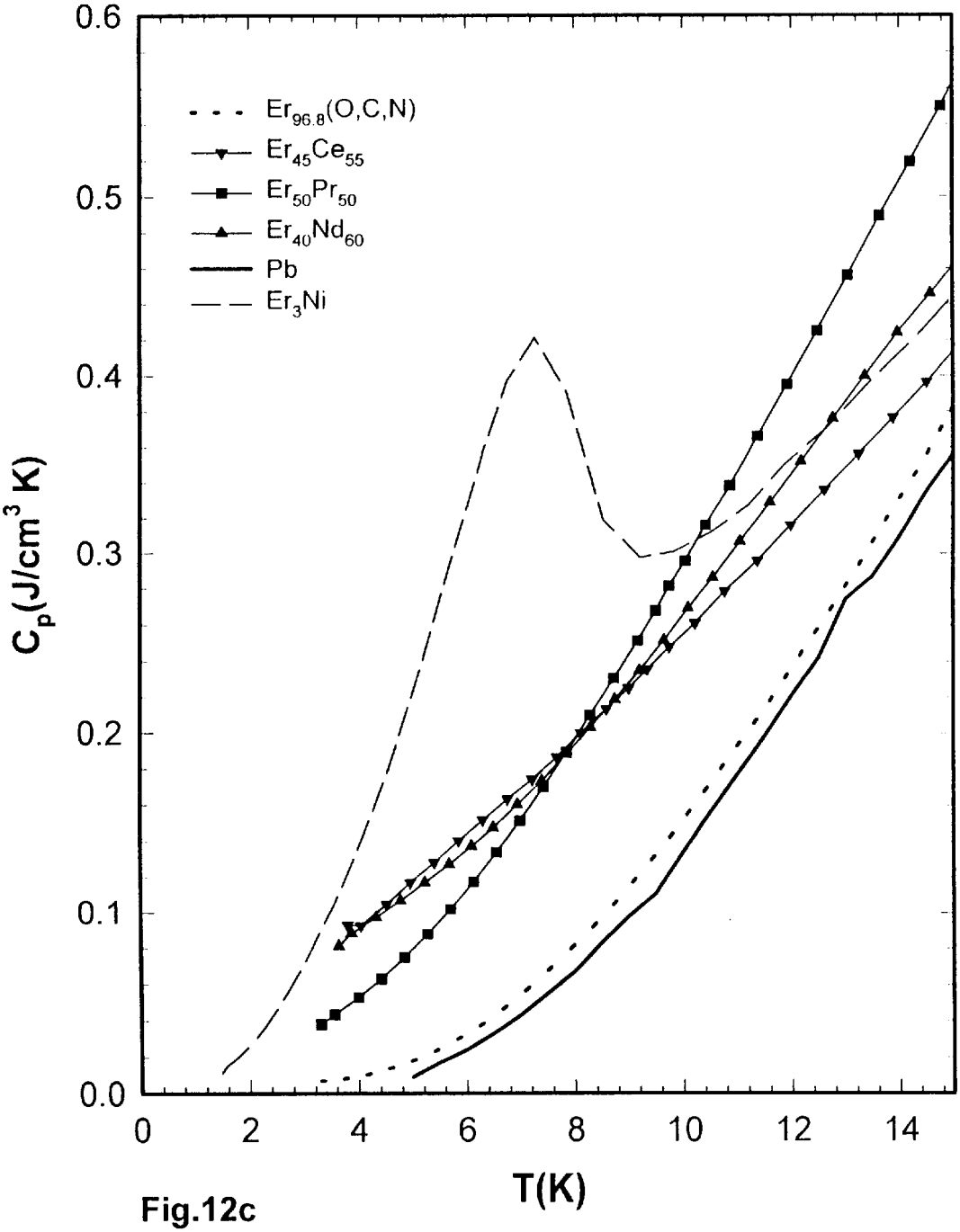
Figure 13A:
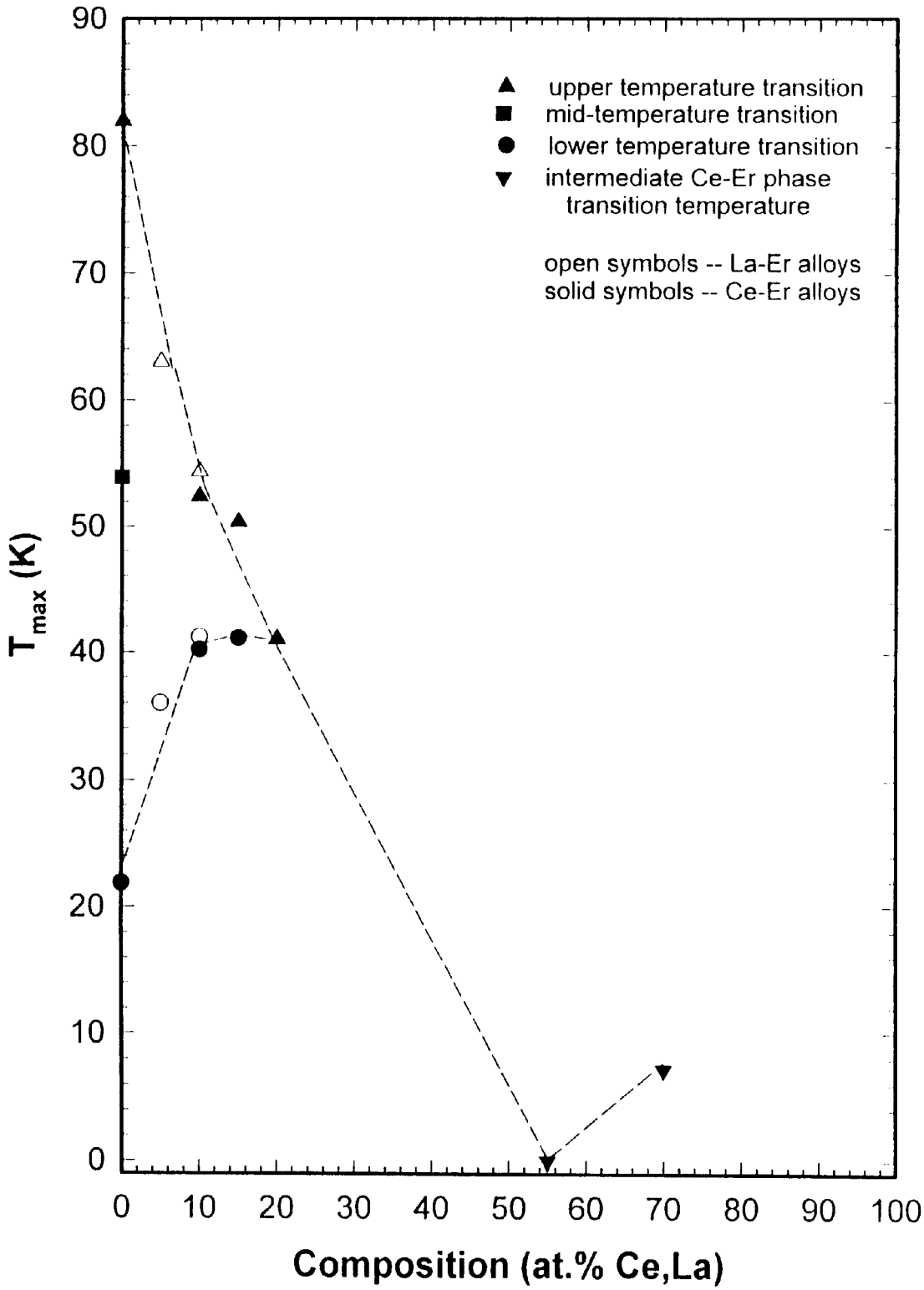
Figure 13B:
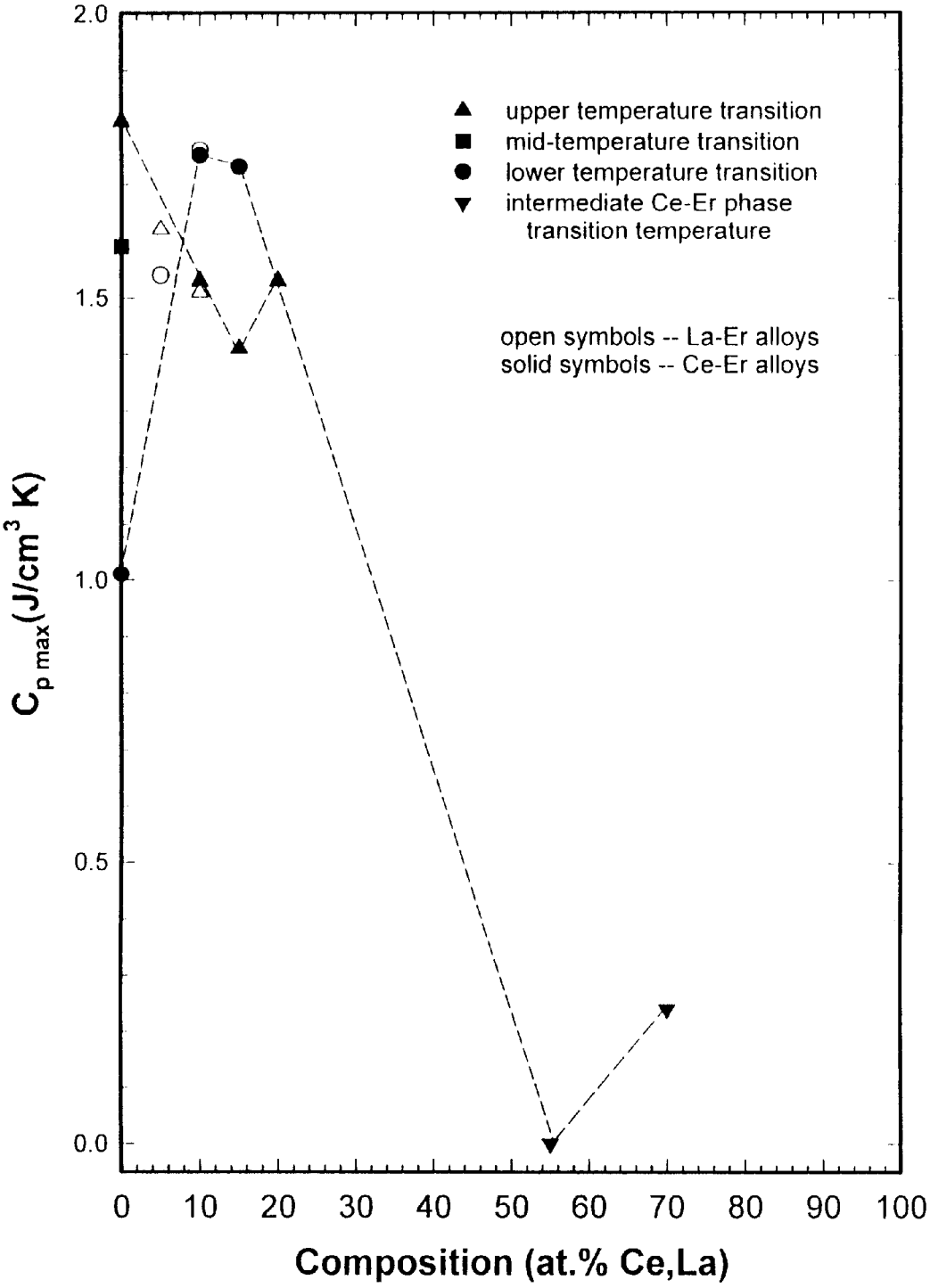
FIG. 13*b* is a graph of the maximum value of the volumetric heat capacity at the corresponding transition temperatures versus Ce/La concentration of La—Er and Ce—Er solid solution alloys.
Figure 14A:
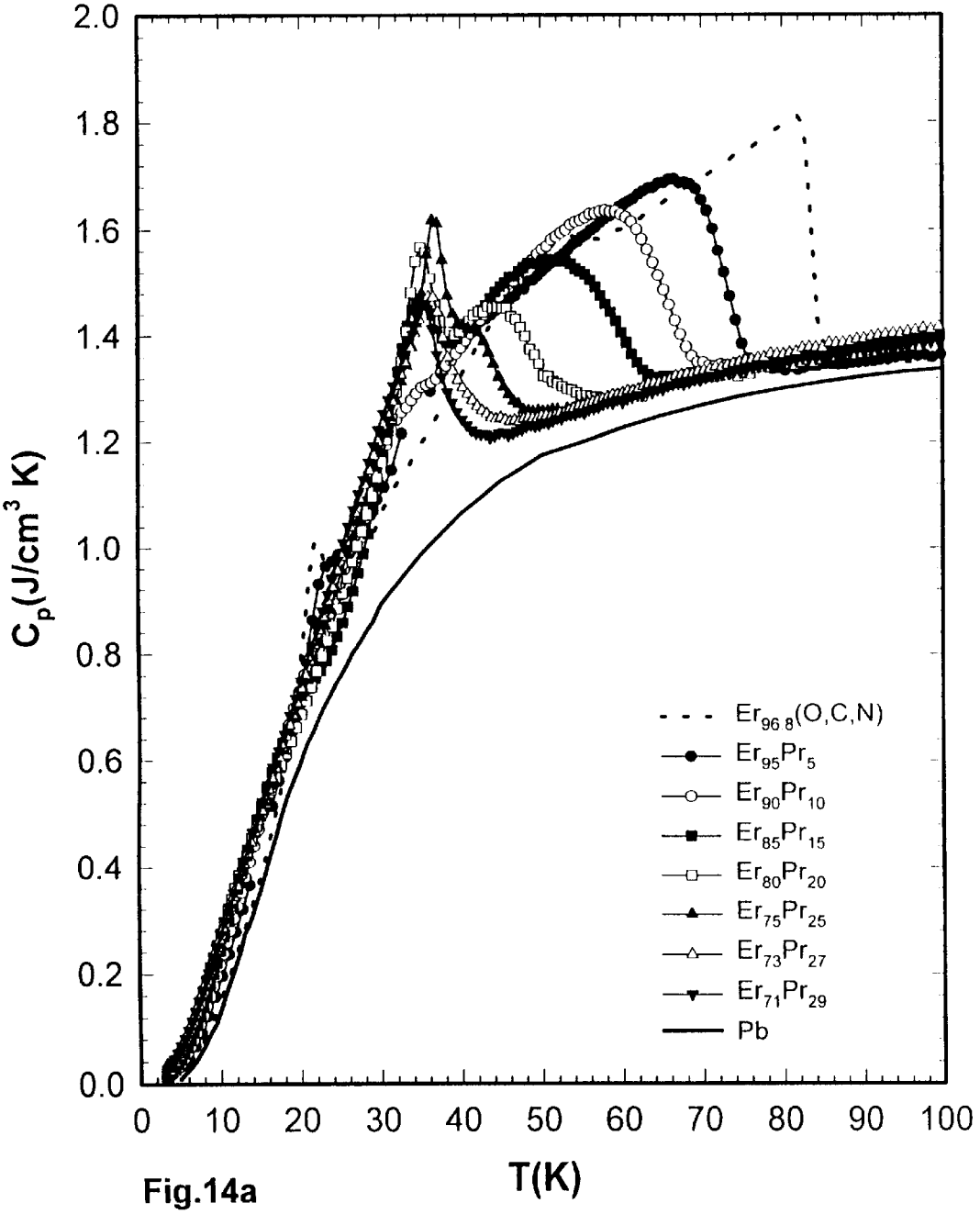
FIGS. 14*a*, 14*b*, 15*a*, 15*b*, 16, and 17 are graphs illustrating the influence of Pr additions on the volumetric heat capacity of Er.
Figure 14B:
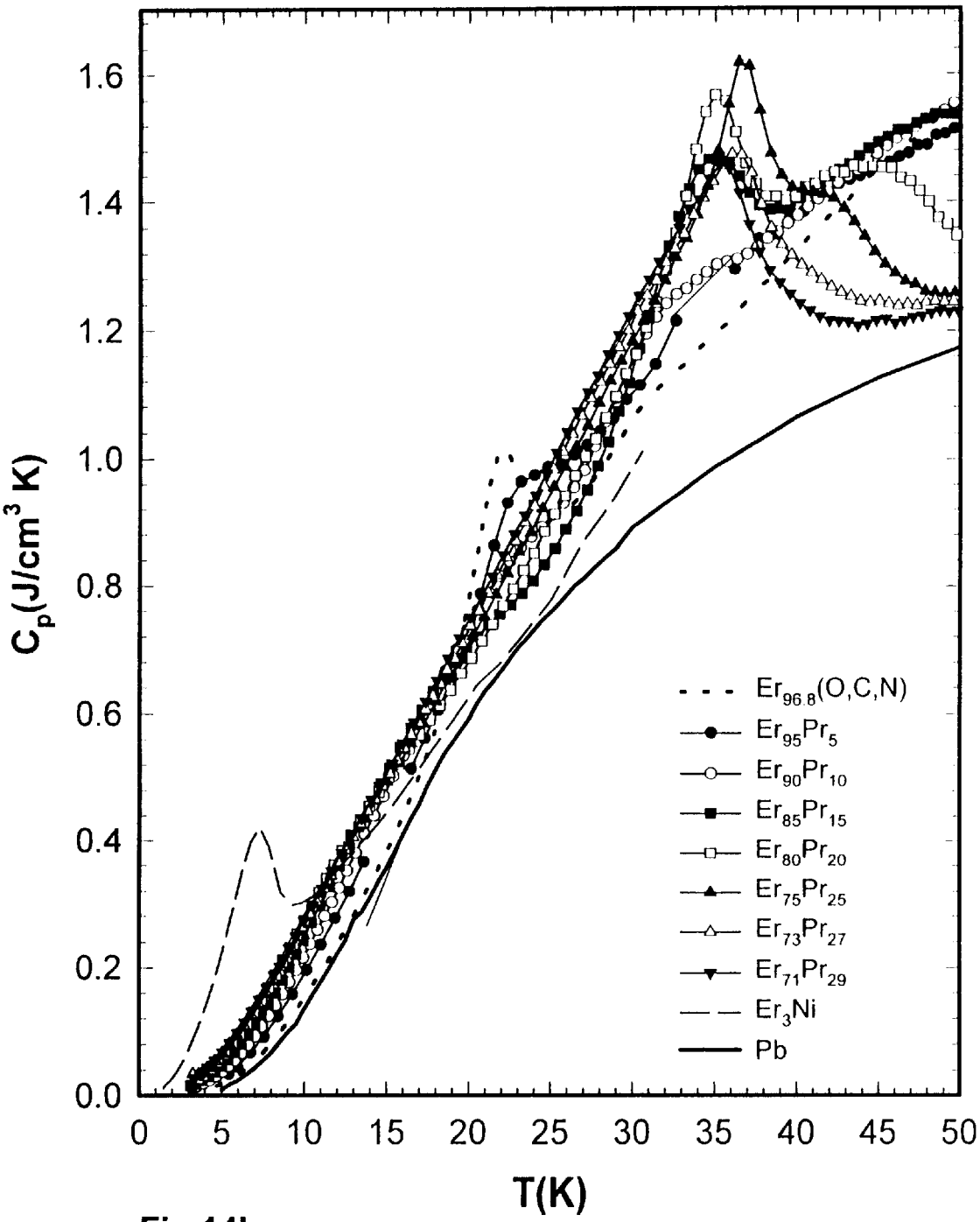

The influence of the addition of the light lanthanide solid solution alloying elements, La, Ce, Pr and Nd, are discussed next. The addition of 5 at. % La, Pr or Nd to Er is shown in FIG. 8, where it is seen that the 82 K peak is shifted downward with La having the greatest effect followed by Pr and Nd. This lowering of the transition temperature is proportional to the size of the alloying agent, i.e. the metallic radii of La, Ce, Pr and Nd are 1.879, 1.825, 1.828 and 1.821 Å, respectively. However, this trend is also consistent with the deGennes factor (0 for La, 0.178 for Ce, 0.800 for Pr and 1.841 for Nd); the smaller the deGennes factor the greater the depression of the 91 K magnetic transition of Er. Furthermore, La seems to destroy the 19 K and 25 K magnetic ordering temperatures of pure Er (see FIG. 2*b*), but enhance and lower the 52 K transition (FIG. 2*b*) perhaps by shifting and combining the entropies of transformations of the 19 plus 25 K peaks with the 52 K peak to give a new peak at 36 K (FIG. 8). On the other hand the Pr and Nd additions destroy the 25 K ordering temperature by shifting the entropy towards the lower ordering temperatures 19 K, while the 52 K peak of pure erbium (FIG. 2*b*) is destroyed, but no new peak is developed at 36 K as for the La addition (FIG. 8). Increasing the alloying addition content up to 10 atomic percent La, Ce, Pr and Nd continues the effects described above for the 5 atomic percent additions, see FIG. 9. It should be noted that Ce and La behave almost identically. The influence of further alloying additions of Ce and Pr are show in FIGS. 10 (for 15 atomic percent) and 11*a* and *b* (for 20 atomic percent), which also includes the results for 20 atomic percent Nd. In the case of Pr a double peak structure has developed. Compare FIGS. 8 (where only high temperature peak exists) and 9 (where there is evidence of the beginning of a double peak structure) with FIGS. 10 and 11*a*. Furthermore, the two peaks are shifting closer together with increasing Pr content (FIGS. 10 and 11*a*). For Nd the double peak structure just starts to develop at 20 atomic percent Nd (FIG. 11*a*) and is clearly evident at 30 atomic percent Nd (FIG. 11*b*). For the Ce alloys we have the opposite behavior. The double peak structure at low Ce concentrations (10 atomic percent, see FIG. 9), gradually merges into one peak as is evident in FIGS. 10 (where the high temperature one has almost disappeared) and 11*a* (where only one peak is evident). At even higher concentrations, approximately 50% of Ce, Pr or Nd, the high temperature heat capacities are much lower than that of the $Er_{96.8}O_{2.7}C_{0.2}N_{0.3}$ (FIG. 12*a* ). But at temperatures below 20 K the opposite is true: the $Er_{45}Ce_{55}$, $Er_{50}Pr_{50}$ and $Er_{40}Nd_{60}$ solid solution alloys have significantly higher heat capacities than both the complex interstitial alloy $Er_{96.8}$(O, C, N) and Pb (see FIG. 12*b*). At even lower temperatures, less than 4 K, the $Er_{45}Ce_{55}$ and $Er_{40}Nd_{60}$ heat capacities are comparable to that of $Er_3Ni$ (an intermetallic compound). It appears that below 3 K they will have higher volumetric heat capacities than $Er_3Ni$ (FIG. 12*c*). The concentration dependencies of the temperatures and the peak heat capacity values of the Er magnetic transitions for Ce and La additions are shown in FIGS. 13*a* and 13*b*, respectively. The behaviors of La and Ce are nearly identical, at least for low concentration (10 atomic percent or less).

Figure 15A:
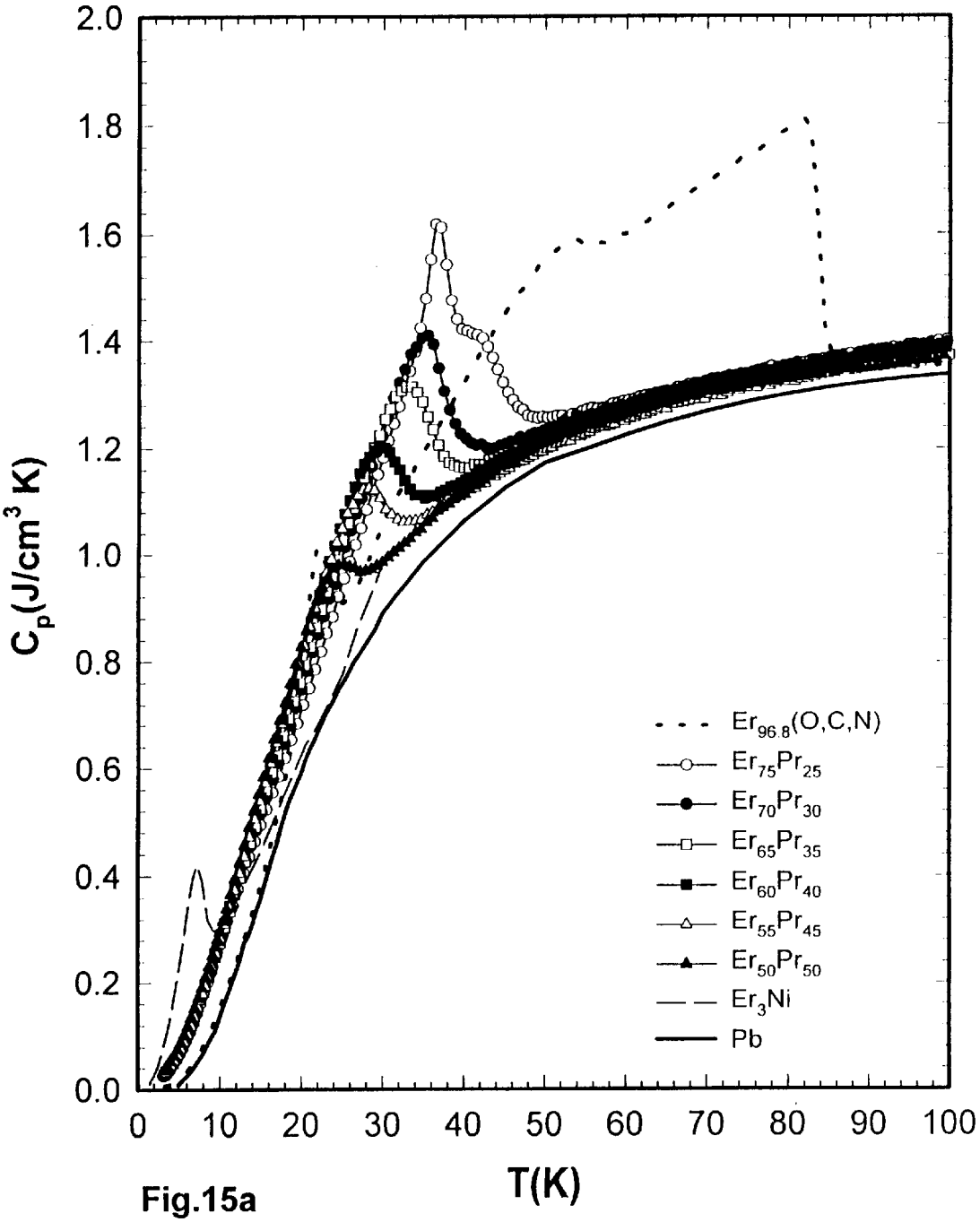
Figure 15B:
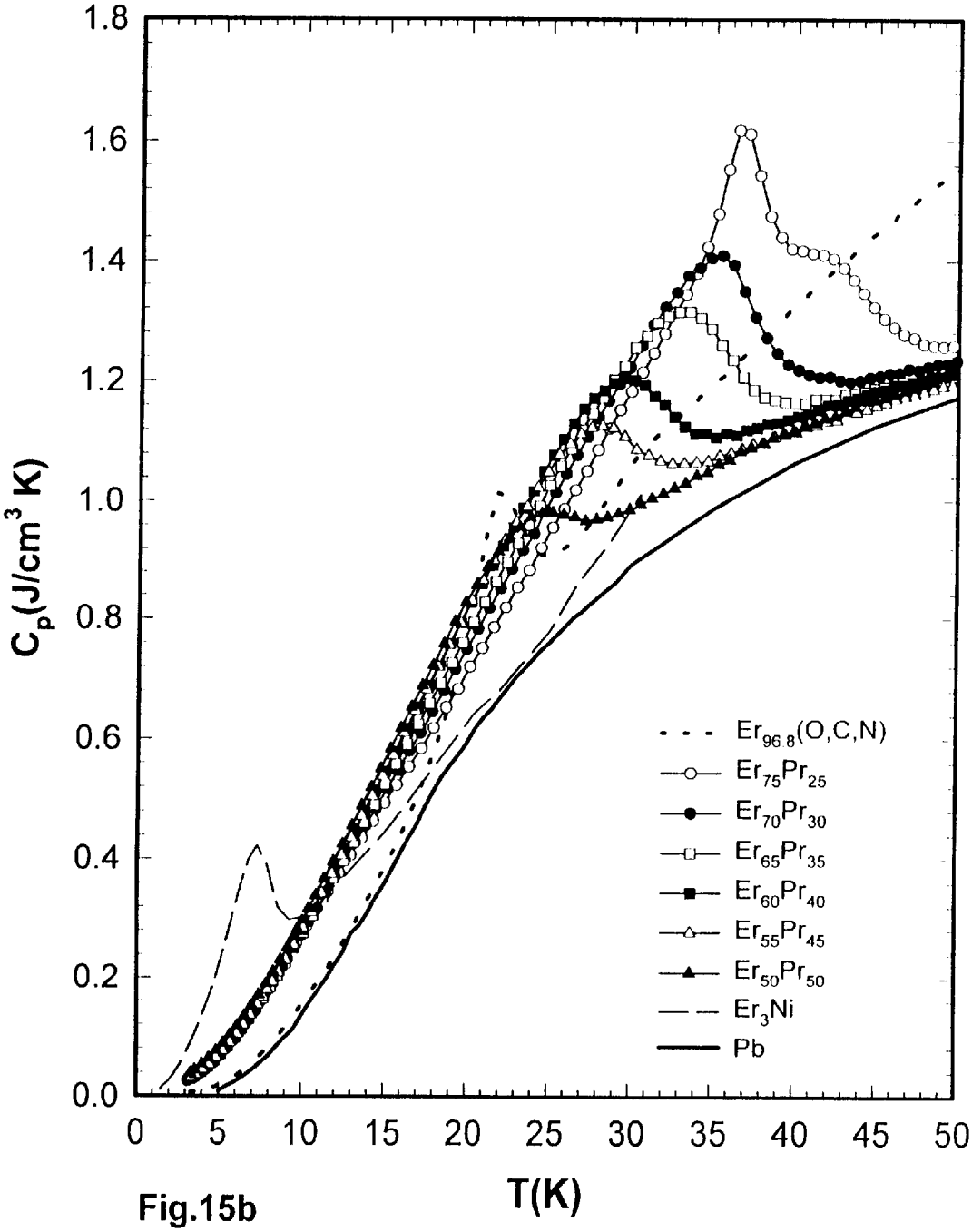
Figure 16:
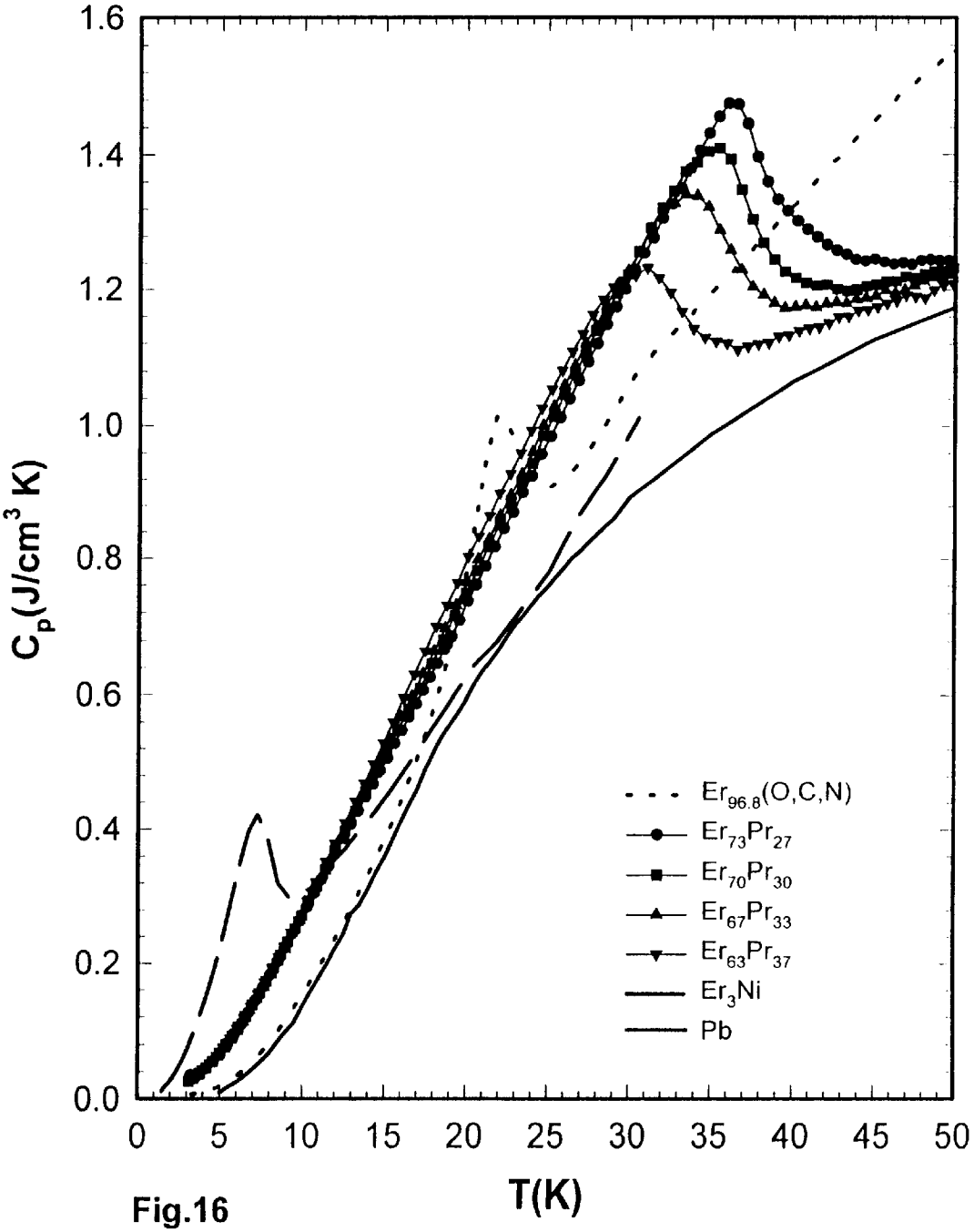
Figure 17:
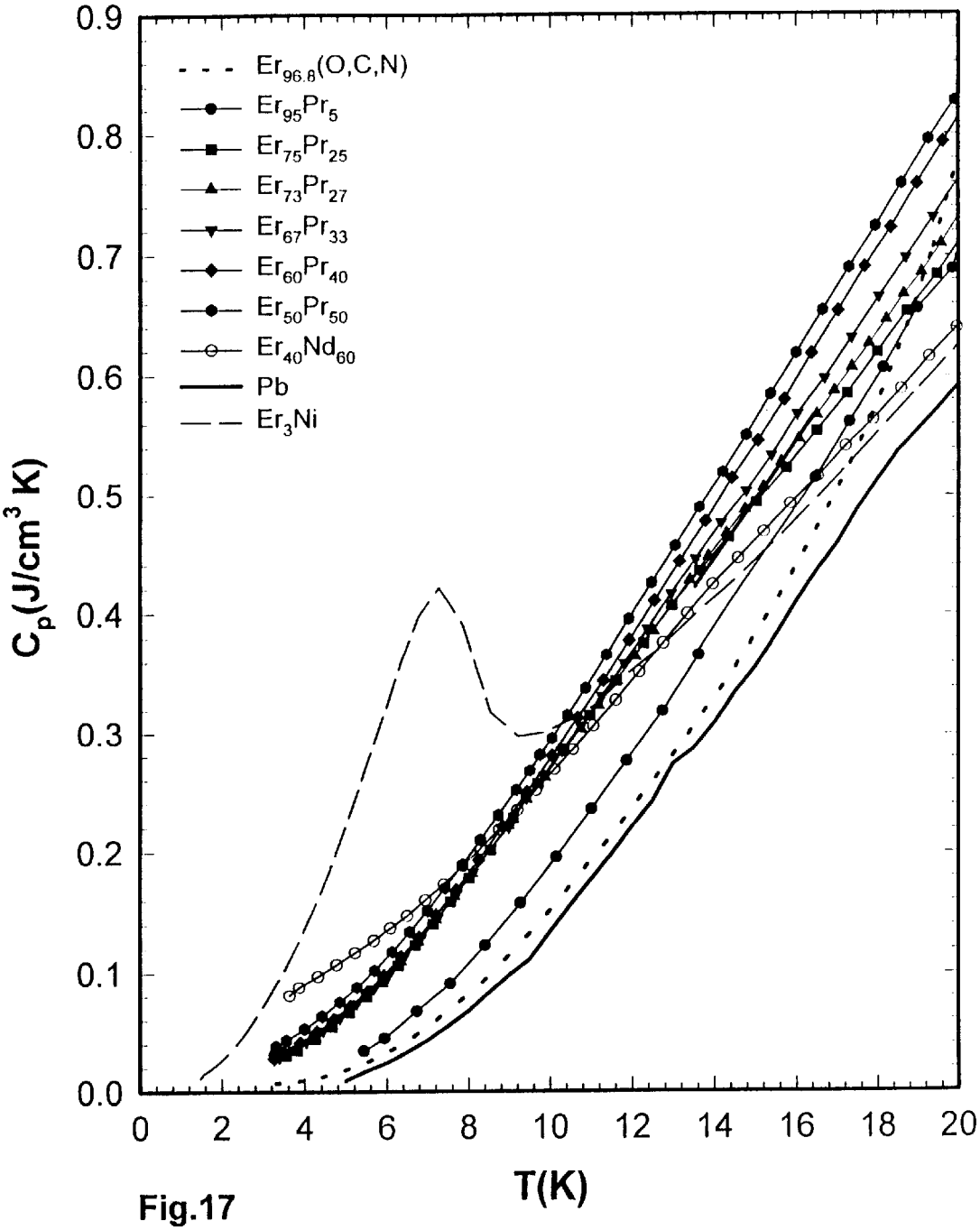
Figure 18A:
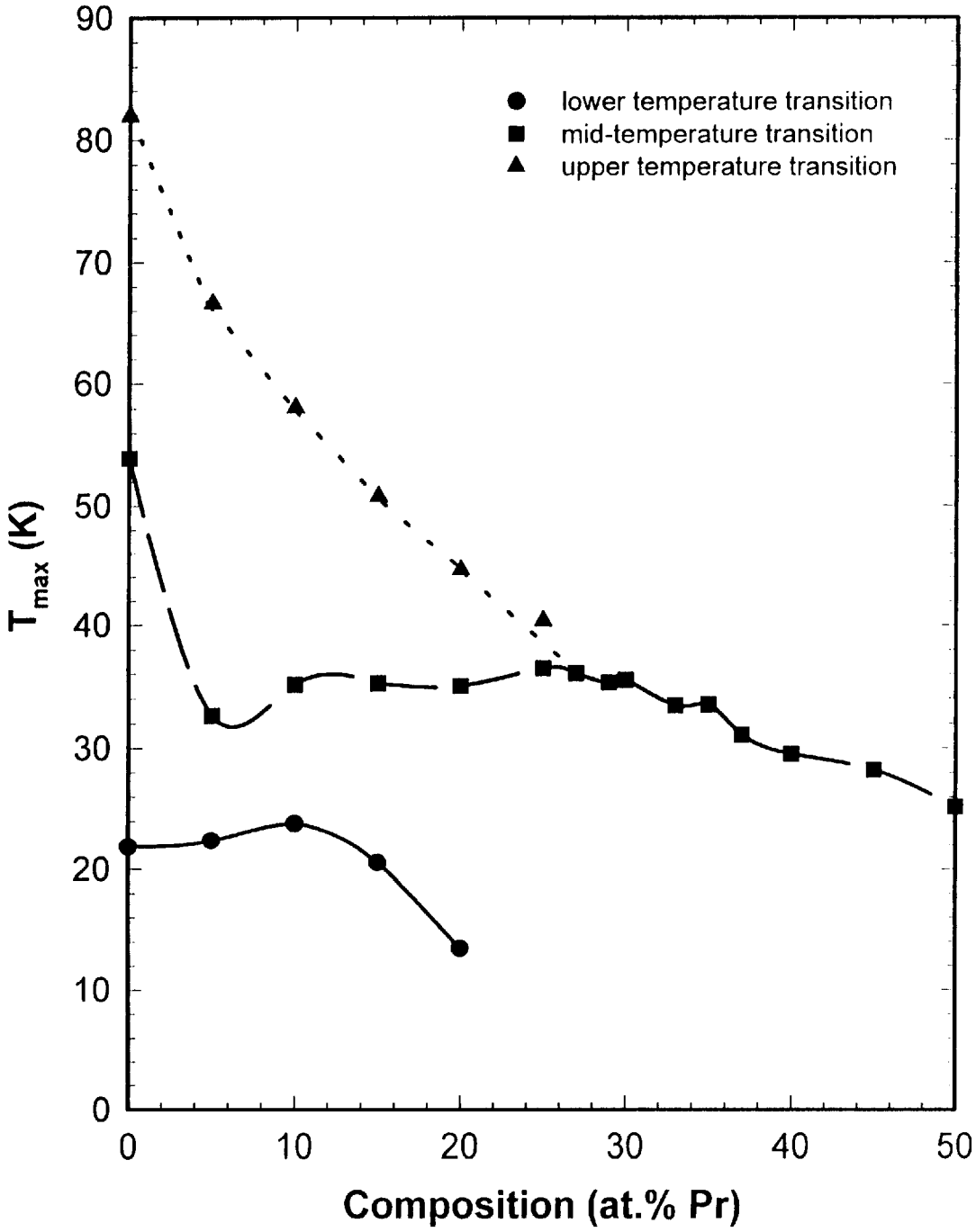
FIG. 18*a* is a graph of transition temperatures versus Pr concentration of Er—Pr solid solution alloys, while 18*b* is a graph of the maximum value of the volumetric heat capacity at the corresponding transition temperatures versus Pr concentration of Er—Pr solid solution alloys.
Figure 18B:
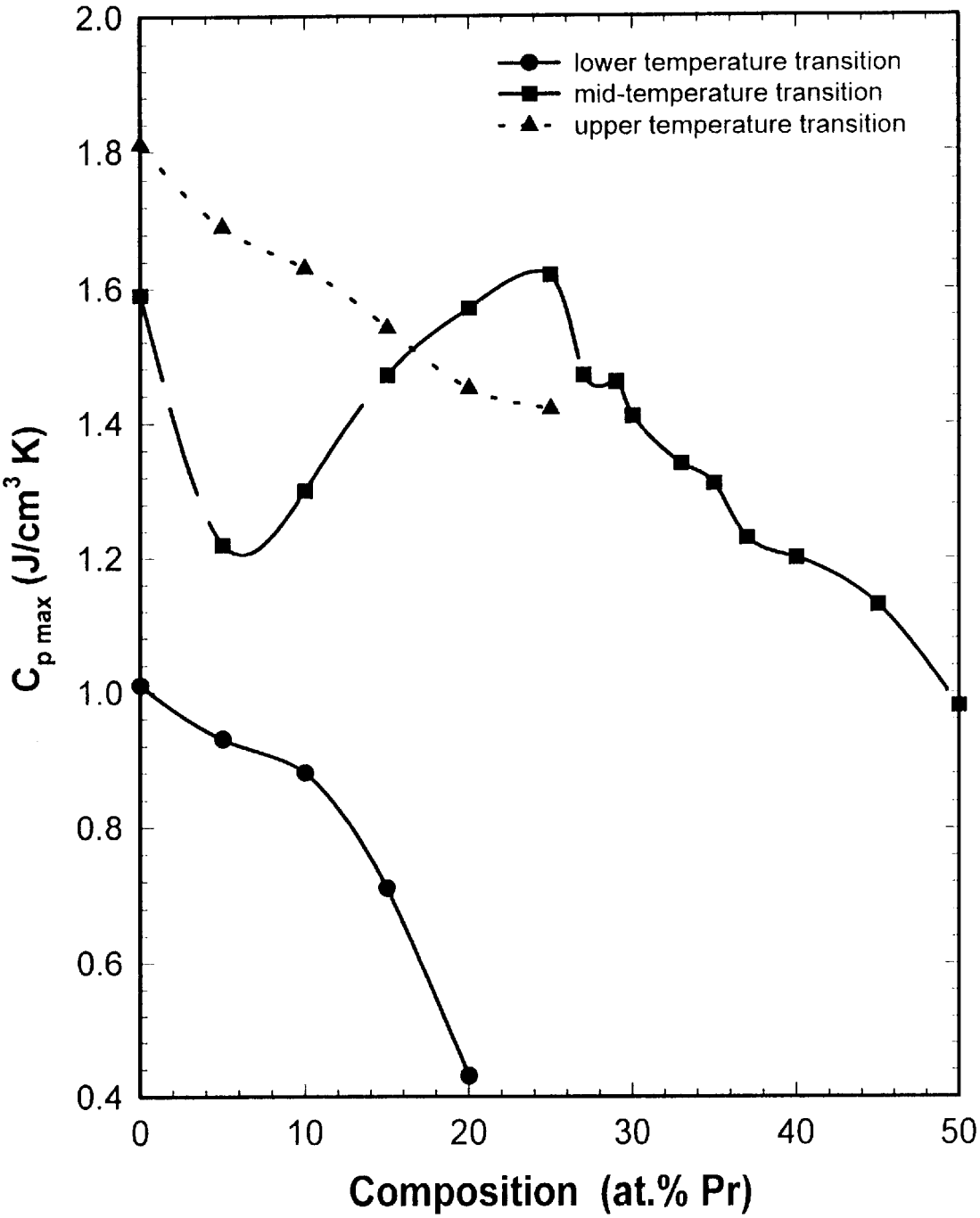
Figure 19:
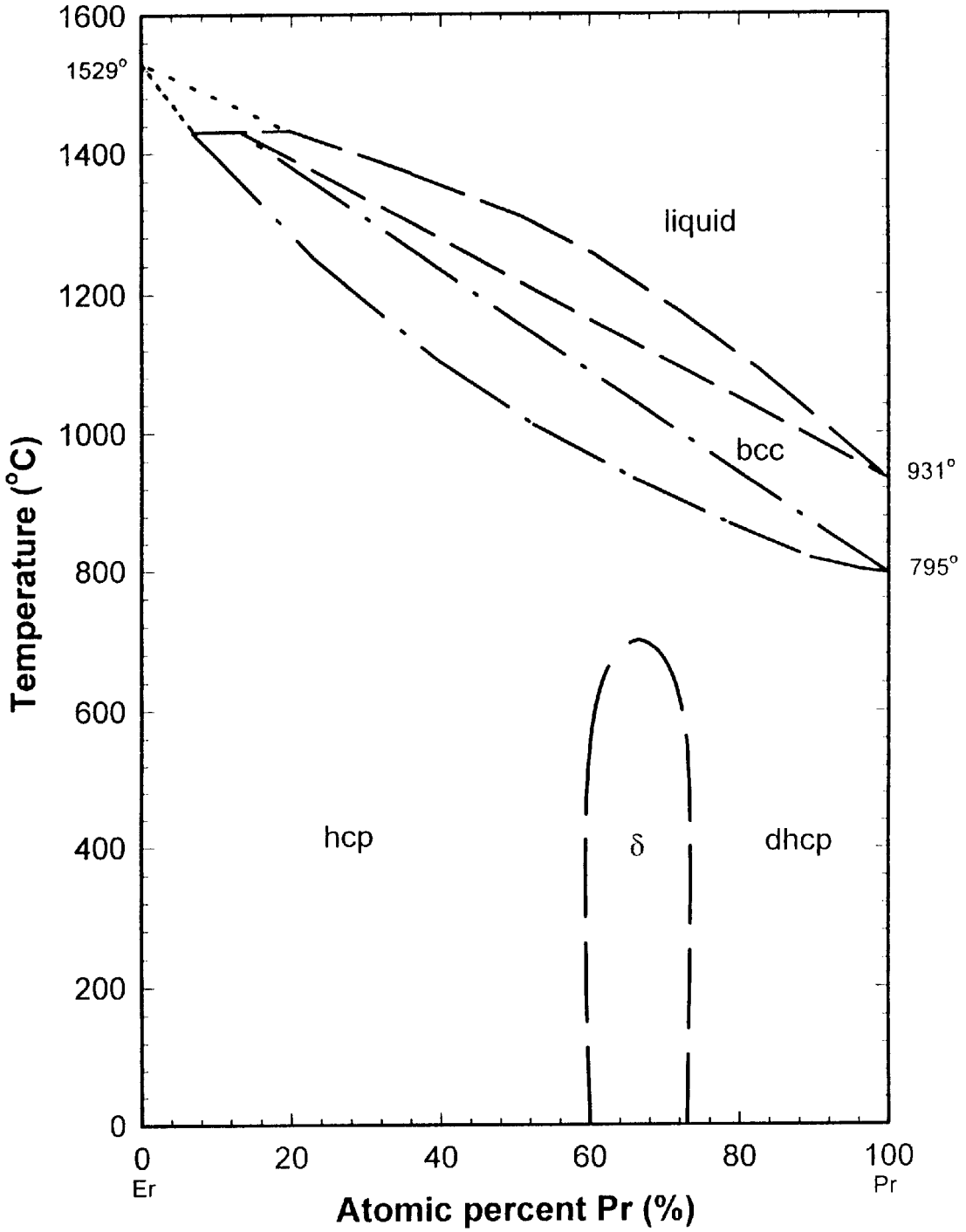
FIG. 19 is a calculated phase diagram for the Er—Pr system.

The influence of Pr solid solution alloying additions on the heat capacities of the magnetic phase transitions of Er are presented in a series of graphs (FIGS. 14–17). The volumetric heat capacities for the low Pr-concentration alloys (5 to 29 atomic percent) are shown in FIGS. 14*a* (3 to 100 K) and 14*b*(3 to 50 K). The upper 82 K magnetic transition of $Er_{96.8}$(O, C, N) is lowered in a regular fashion as Pr concentration increases (FIG. 14*a*) . The shift of the 19 K transition upward as the Pr concentration increases and eventually merges with the high temperature (82 K) peak into one peak at ~36 K is more evident in FIG. 14*b*. It is noted that below 18 K the heat capacity of the Pr containing alloys is significantly larger than that of $Er_{96.8}O_{2.7}C_{0.2}N_{0.3}$ alloy and Pb, by about 80% more than the former and about 125% more than the latter at 10 K. Furthermore, their heat capacities are also larger than that of $Er_3Ni$ above 11 K. The heat capacities of the high Pr concentration alloys are shown in FIGS. 15*a* (3 to 100 K) and 15*b* (3 to 50 K) with the data for the $Er_{75}Pr_{25}$ alloy repeated here from FIGS. 14*a* and 14*b* as a common guide to compare the results presented in the two sets of figures. The single peak for concentrations greater than 27 atomic percent Pr continues to decrease in both temperature and magnitude with increasing Pr concentrations (FIGS. 15*a* and 15*b*). The details at lower temperatures are presented in FIG. 15*b*. Of the compositions shown in FIGS. 14 and 15, the ones which give rise to a single broad peak between 25 and 37 K are of particular interest as regenerator materials. The detailed heat capacities as a function temperature for the 27, 30, 33 and 37 atomic percent Pr concentrations are shown in FIG. 16. Again, we note that these alloys have significantly higher heat capacities than that of Pb at all temperatures below 100 K; than that of $Erg_{96.8}C_{2.7}O_{0.2}N_{0.3}$ between 24 and 33 to 40 (depending on the Pr content) and below 18 K; and than that of $Er_3Ni$ above 11 K. The low temperature heat capacities below 20 K for some selected Pr—Er alloys are shown in FIG. 17, along with that of $Er_{40}Nd_{60}$, Pb, $Er_{96.8}O_{2.7}C_{0.2}N_{0.3}$ and $Er_3Ni$. The heat capacities of the Pr—Er alloys in this region increase in a regular manner with increasing Pr content. In all cases between 10 and 20 K the heat capacities of the Pr—Er alloys are higher than the four non-Pr—Er materials with the highest values for the $Er_{50}Pr_{50}$ solid solution alloy. For example, the heat capacity of the $Er_{50}Pr_{50}$ alloy is 185% larger than that of lead at 10 K, and essentially the same as that of $Er_3Ni$ intermetallic compound also at 10 K. The concentration dependencies of the magnetic transition temperatures and the heat capacity values (maxima) at the respective transition temperatures of these Er—Pr alloys are shown in FIGS. 18*a* and 18*b*, respectively. It is seen that the upper (82 K) and mid-temperature (54 K) transitions merge into one at approximately 26 atomic % Pr (FIG. 18*a*), and with this merger the maximum heat capacity values grow and reach fairly high values [almost as much as that of $Er_{96.8}$(O, C, N) alloy at 82 K] at 27 atomic % Pr (FIG. 18*b*). Also it is seen that the transition temperature and the heat capacity peak value of the lowest transition are rapidly reduced by Pr additions, and the transition is no longer observed in the $Er_{75}Pr_{25}$ alloy. It would appear that the magnetic transition entropy of the lowest transition temperature is shifted to the mid-temperature transition, which is evident with the increase in the peak heat capacity values for Pr concentrations greater than 5 atomic percent. Ordinarily we would expect it to fall as Pr is added to Er just from a pure dilution effect; which is what we observe for the upper transition (FIG. 18*b*). The anomalous or unusual behavior of both the magnetic transition temperatures and the heat capacity peak value suggest that the unexpected effect occurs in the 20 to 35 atomic % Pr region. One possibility might be the formation of the δ-phase which has the Sm-type structure and which is found in alloys composed of a heavy and light lanthanide. Unfortunately, the phase diagram of the Pr—Er system is not known, but by using the method proposed by Gschneidner[1] we can estimate the phase relationships in this system. The calculated phase diagram is shown in FIG. 19, and it is evident that the unusual magnetic behavior in the 25 to 35 atomic percent Pr cannot be due to the δ-phase since it is expected to form in the 60 to 75 atomic percent Pr region. Thus it would appear that some other unknown phenomenon is responsible for the observed effect.

Figure 20A:
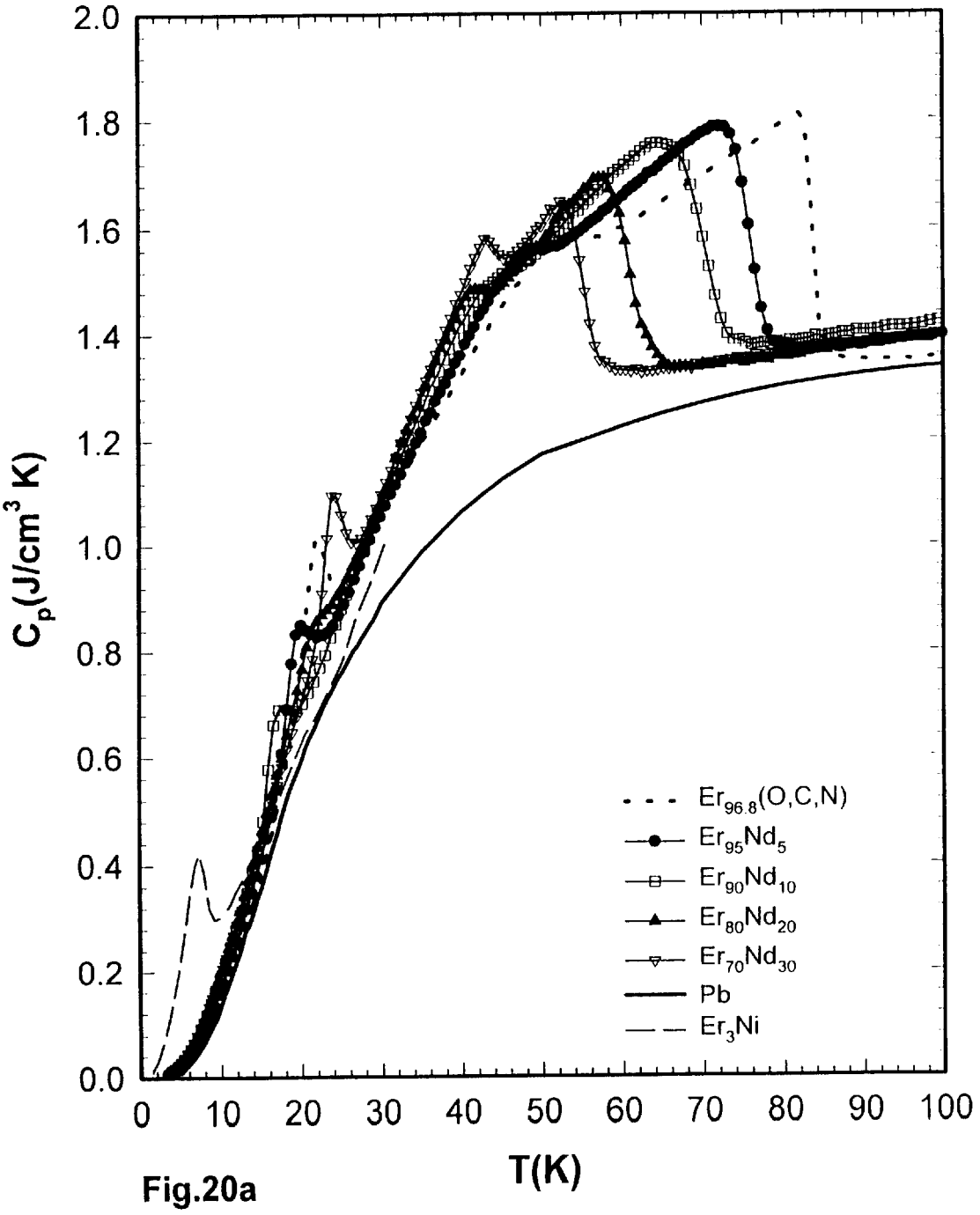
FIGS. 20*a* and 20*b* are graphs of volumetric heat capacities of the listed Er—Nd solid solution alloys, Pb and $Er_3Ni$ (an intermetallic compound) over the temperature ranges set forth, showing the effect of Nd content on the volumetric heat capacity of Er.
Figure 20B:
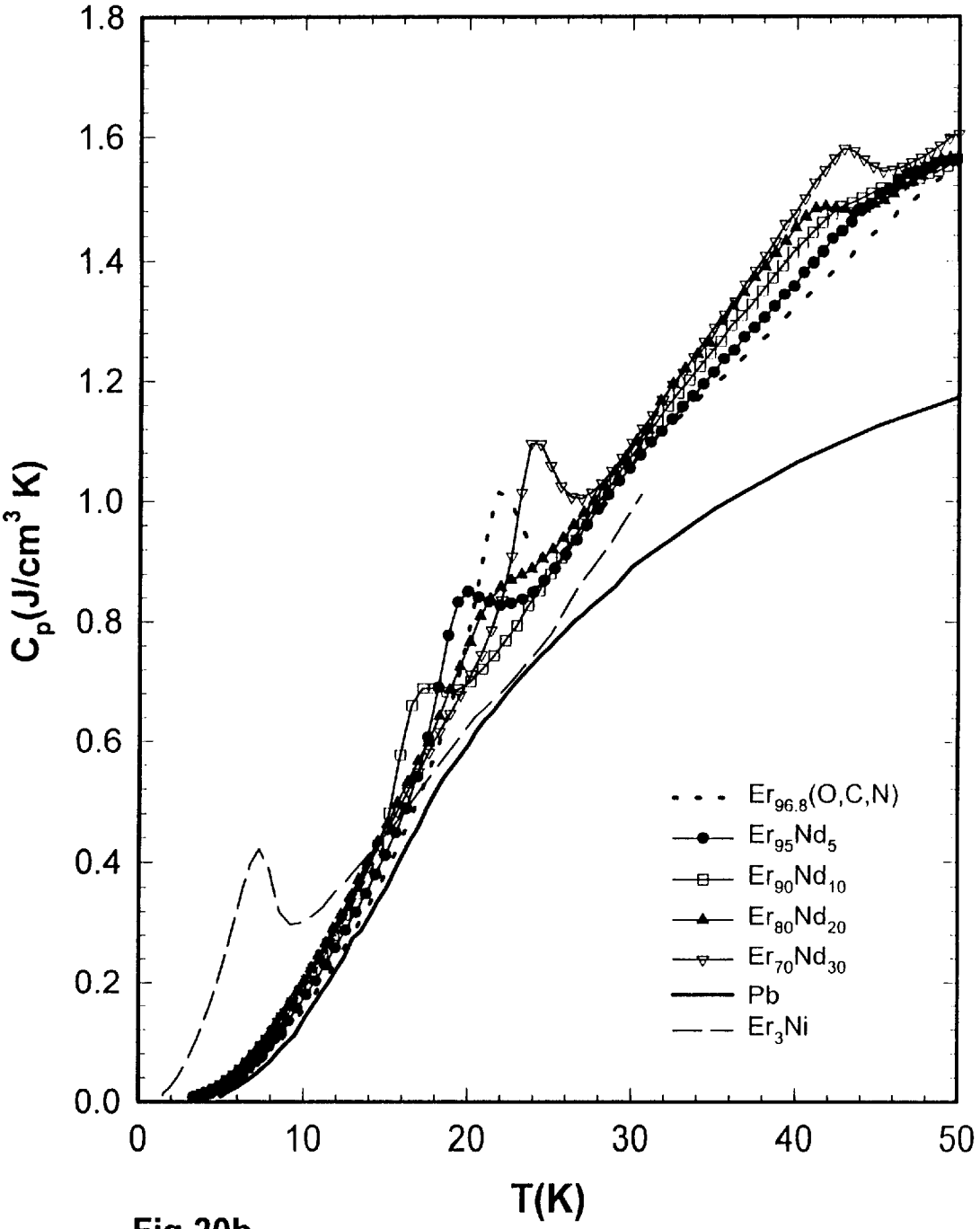
Figure 21A:
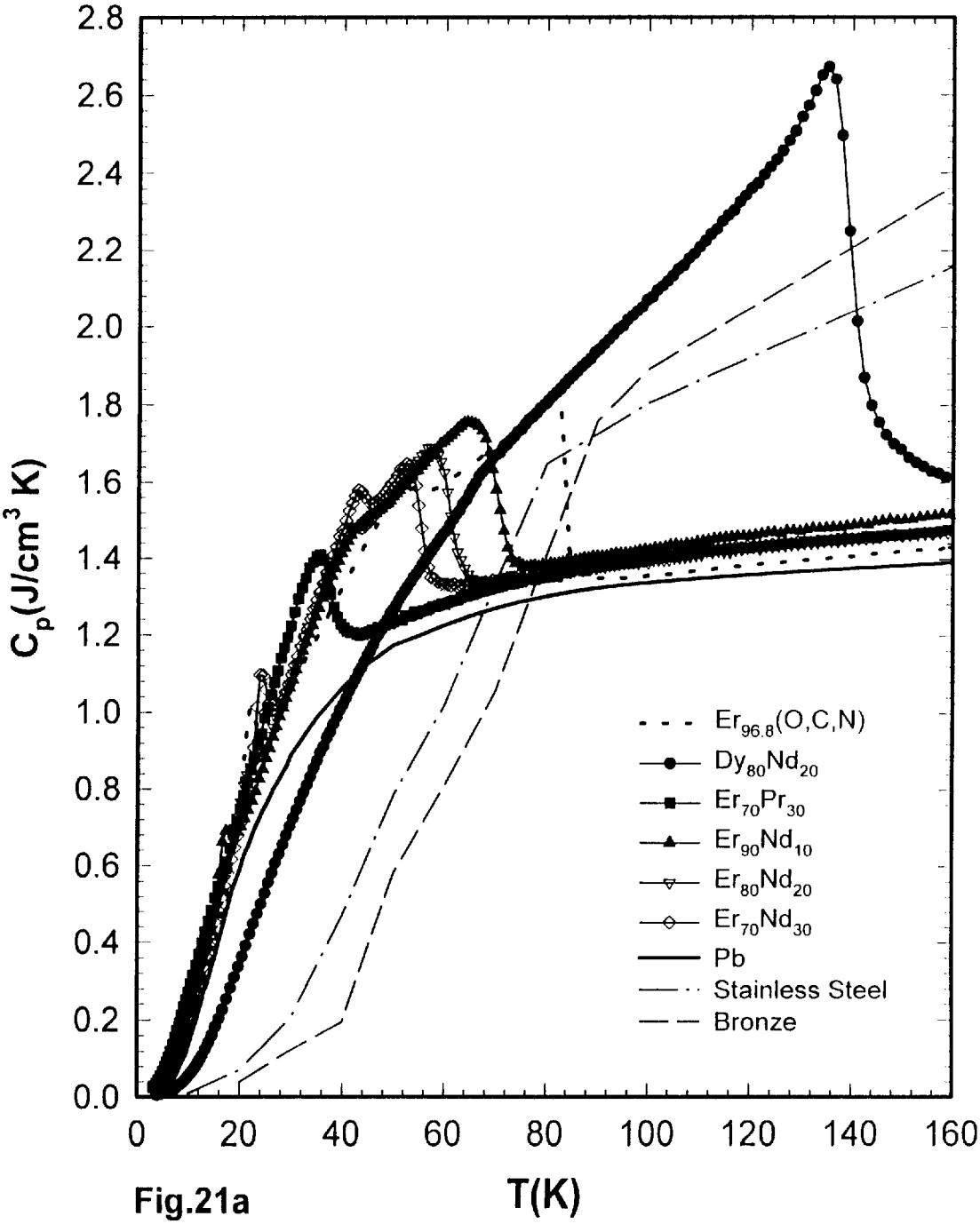
FIGS. 21*a* and 21*b* are graphs of volumetric heat capacities of the listed rare earth metal solid solution alloys and stainless steel, Pb, and bronze over the temperature ranges set forth, showing the effect of Nd and Pr content on Er and Dy volumetric heat capacities.
Figure 21B:
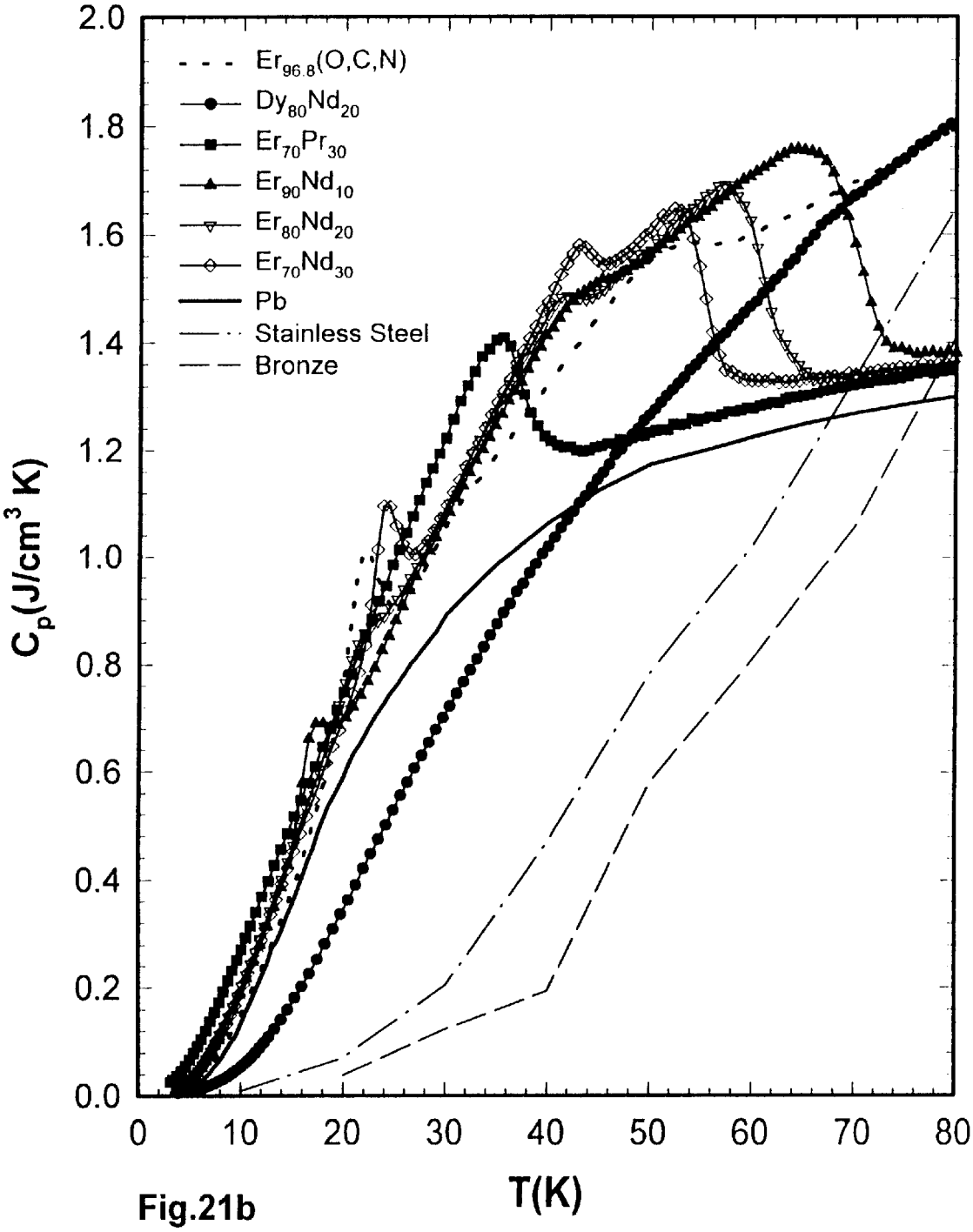

The effect of Nd solid solution alloy additions on the Er magnetic transitions is shown in FIG. 20*a*. The upper transformation is lowered by Nd but at a much slower rate than La, Ce and Pr which is quite evident in FIGS. 8, 9, 11*a* and 11*b*. The heat capacities are 5 to 8% larger than that of $Er_{96.8}$(O, C, N) in the appropriate temperature regions. For cryocooler applications below 65 K the $Er_{90}Nd_{10}$ solid solution alloy would be a better regenerator material than $Er_{96.8}$(O, C, N) down to about 30 K (FIG. 20*a*). Keeping in mind that the $Dy_{80}Nd_{20}$ alloy was the best material between 80 and 140 K (i.e. had the highest heat capacity), see FIGS. 4*b* and 4*c* and essentially the same as $Er_{96.8}$(O, C, N) between 80 and 65 K (see FIG. 4*a*, but it is more clearly seen in FIGS. 21*a* and 21*b*), this makes the $Dy_{80}Nd_{20}$ the best material for the low temperature end of the upper (first) stage regenerator of the cryocooler. From the high heat capacity of the $Er_{90}Nd_{10}$ alloy it would be the top candidate material for the high temperature end of the lower (second) stage regenerator of the cryocooler, since at about 69 K the heat capacities of the $Dy_{80}Nd_{20}$ and $Er_{90}Nd_{10}$solid solution alloys are the same (see FIG. 21*b*) With respect to the 19 K temperature of Er, Nd alloying additions exhibit a behavior which is unique, see FIG. 20*b*. Initial additions lower the transition temperature by about 1 K for the $Er_{95}Nd_5$, and about 2 K for the $Er_{90}Nd_{10}$ alloys, while larger amounts raise the temperature back up to about 20 K for 20 atomic percent Nd and to 24 K for 30 atomic percent Nd. Furthermore, the magnitude of the peak (the height above the baseline determined from the heat capacities above and below the peak) decreases initially with increasing Nd content, almost disappearing for the $Er_{80}Nd_{20}$ alloy and then further additions of Nd enhance the peak height for $Er_{70}Nd_{30}$ alloy (see FIG. 20*b*).

Figure 22:
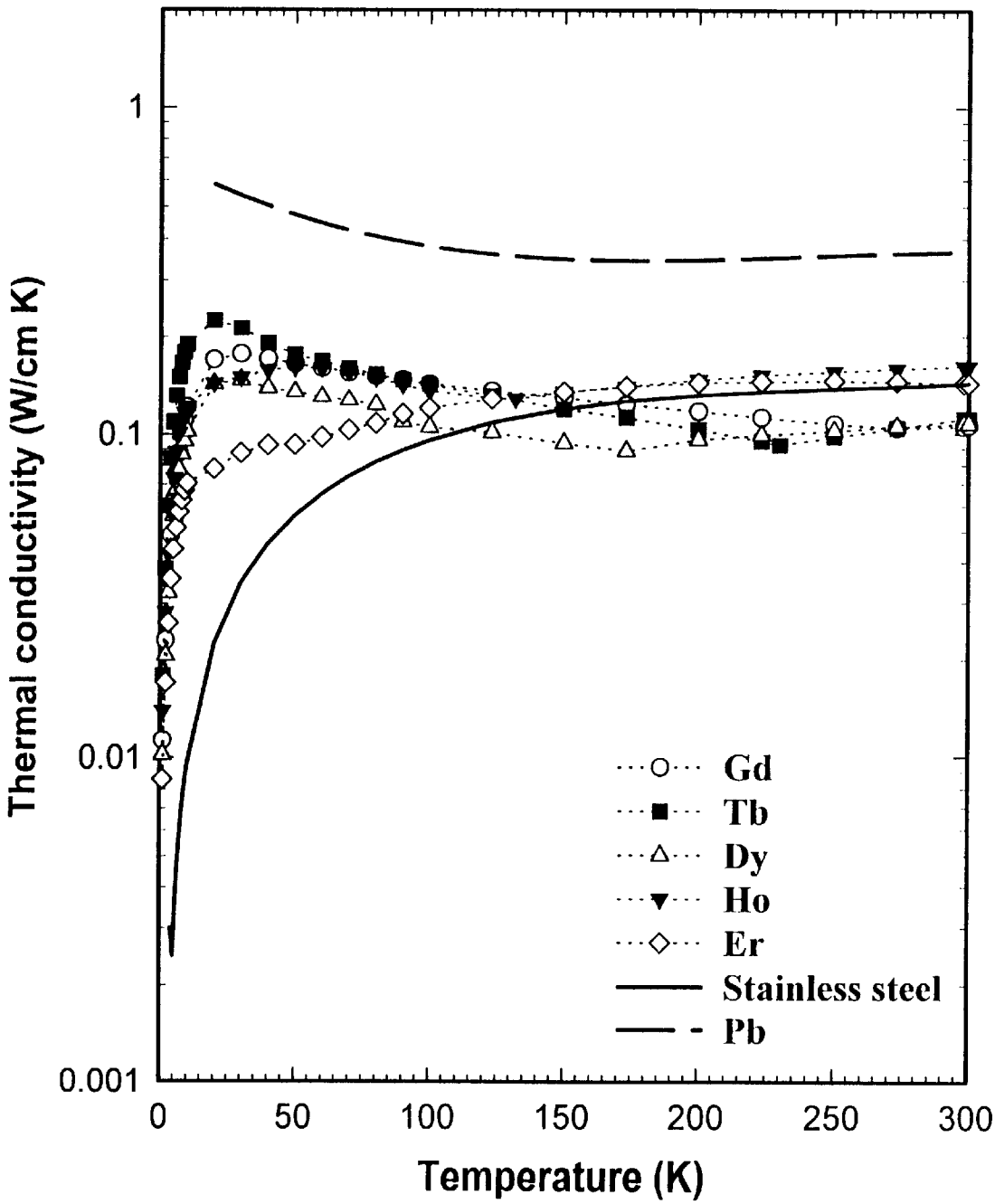
FIG. 22 is graph of thermal conductivities versus temperature of Gd, Tb, Dy, Ho, Er, stainless steel, and Pb.
Figure 23:
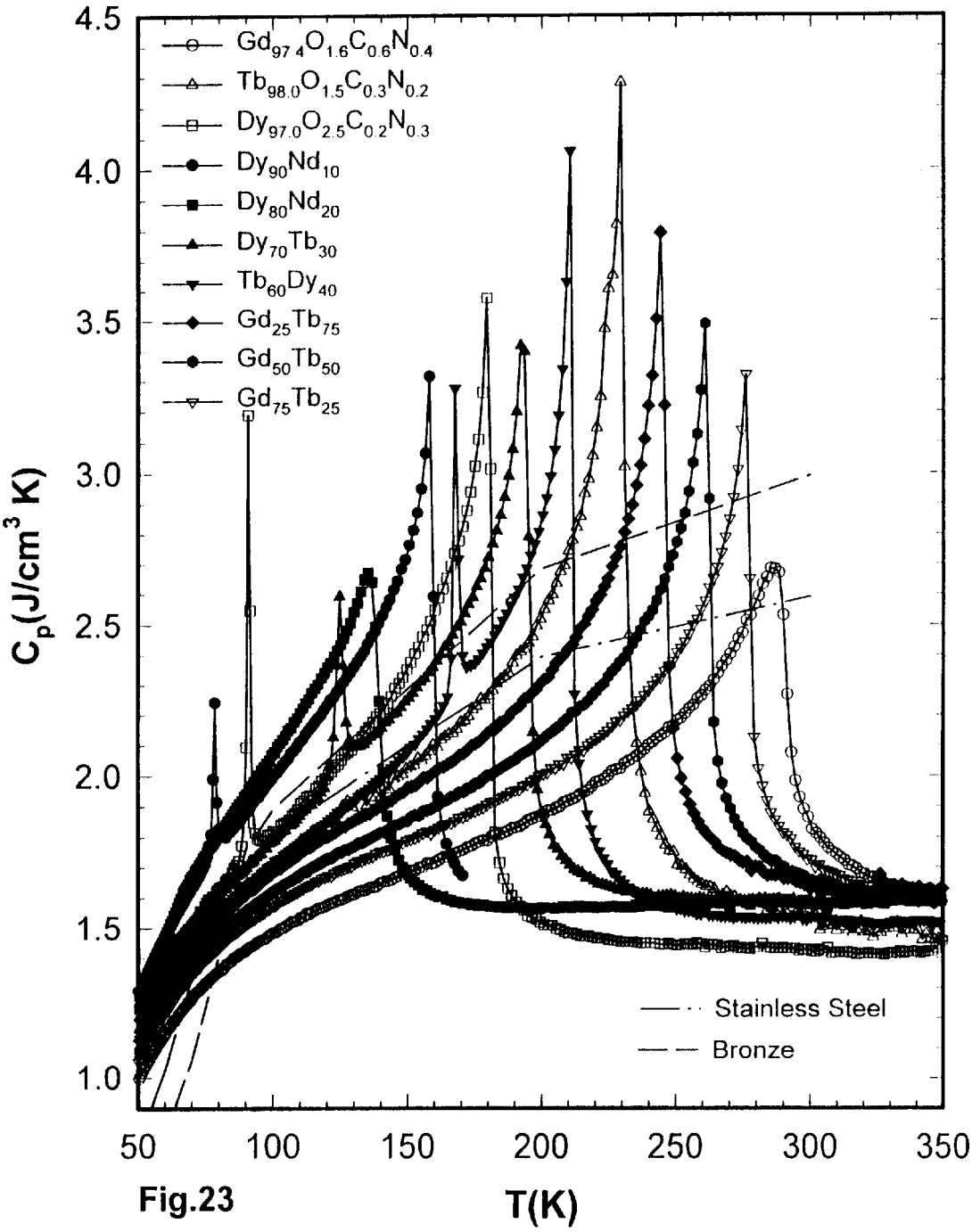
FIGS. 23, 24, 25, and 26 are graphs of volumetric heat capacities of the listed rare earth metal solid solution alloys and stainless steel, bronze and Pb over the temperature ranges set forth.

In addition to having the appropriate large heat capacity values, the cryocooler regenerator materials should have a low thermal conductivity to reduce longitudinal heat losses. As seen in FIG. 22, the thermal conductivities of the pure heavy lanthanide metals Gd, Dy and Er[2] are comparable to that of stainless steel over the 60 to 300 K temperature range, i.e. the region in which the lanthanide metals compete with stainless steel[3]. While in the 10 to 60 K temperature range, where Pb is the prototype regenerator material[2] the lanthanide metals are significantly better (i.e. have lower thermal conductivities) than Pb. And when one considers the fact that the values shown are for fairly pure lanthanide metals, the effect of alloying will lower the thermal conductivities, improving their competitiveness with the lead and stainless steel prototypes.

The ultimate tensile strength of the pure lanthanide metals, R, and their interstitially-doped alloys, R(O, C, N), are listed in Table 1, along with those of Pb, bronze and stainless steel.

Table 1. Ultimate Tensile Strength of Pure, R, and Interstitially Strengthened, R (O, C, N), Heavy Lanthanide (Rare Earth) Metals, along with Those of Lead, Bronze, and Stainless Steel

| | Ultimate Tensile Strength of Pure R | | Ultimate Tensile Strength of R (O, C, N) | | |
|---|---|---|---|---|---|
| Metal (R) | (kg/mm²) | (MPa) | (kg/mm²) | (MPa) | Reference |
| Gd | 12.0 | 118 | 21.9 | 215 | 4 |
| Tb | (13)[a] | (127)[a] | (23)[a] | (226)[a] | 4 |
| Dy | 14.2 | 139 | 24.7 | 242 | 4 |
| Ho | (14)[a] | (137)[a] | 26.4 | 259 | 4 |
| Er | 13.9 | 136 | 29.1 | 285 | 4 |
| Pb | 1.2 | 12 | 2.0[b] | 20 | 5 |
| Stainless Steel (316) | — | — | 52.5 | 515 | 6 |
| Bronze (90 Cu, 10 Zn) | — | — | 26.0 | 255 | 5 |

[a]Estimated by inventors
[b]Antimony hardened lead alloy, commonly used in cryocooler regenerators.

It is seen that these lanthanide materials are more than 10 times stronger than Pb when comparing the pure metals, or the Sb-strengthen Pb alloy when comparing it with the interstitially strengthened R(O, C ,N) alloys. The strength of the R(O, C, N) alloys are about the same as bronze and about half of that of the stainless steel. This indicates that the R(O, C, N) alloys and the other R—M alloys described in this invention should have reasonable strength for cryocooler regenerator applications, and will not suffer the problem of the loss of sphericity that has plagued Pb in such applications. Because of lead's low mechanical strength it will deform under the pressure used in regenerators which causes the spheres to flatten out.

As noted earlier the proposed regenerator rare earth solid solution alloys are ductile and can be easily fabricated into a variety of forms, such as thin sheets (ribbons), wires and spheres. Ribbons, wires and spheres have been made of the $Er_{96.8}O_{2.7}C_{0.2}N_{0.3}$ solid solution alloy. The ribbon can be 2 mil (0.002 inch, or 0.05 mm) thick, and the wire and the spheres can have a diameter of 12 mil (0.012 inch, or 0.30 mm). The ribbon was rolled and the wire was drawn using standard metallurgical rolling and drawing procedures, while the spheres were prepared by the plasma rotating electrode process (PREP) whereby small droplets of molten metal (alloy) are spun-off of a rapidly rotating cylinder, the end of which is heated by the plasma to the metal's (alloy's) melting point.

Oxidation studies have also been carried out on selected solid solution alloys: $Er_{96.8}O_{2.7}C_{0.2}N_{0.3}$, $Er_{73}Pr_{27}$ and $Er_{60}Pr_{40}$. The alloys were placed in an open air furnace at 123±5° C., and after 30 weeks no observable weight gain had been detected. This test indicates that they are stable to oxidation at room temperature for an extremely long time—equal to or better than the lifetime of the cryocooler itself. Even assuming that oxidation at 123° C. during the 30 weeks was beyond the accuracy of weighing (0.1 mg) at room temperature the oxidation will be approximately $2^{10}$ (1024) times slower, as each 10° C. reduction of the temperature from 123 to 23° C. reduces the rate of reaction twofold.

The $Er_{96.8}O_{2.7}C_{0.2}N_{0.3}$ spheres were tested as regenerator material in a pulse tube cryocooler. Using just stainless steel as the regenerator a no load temperature of 55 K was attained. When the low temperature side of the regenerator contained a layer of Pb spheres the no heat load temperature was 42 K and when the Pb spheres were replaced by the $Er_{96.8}O_{2.7}C_{0.2}N_{0.3}$ spheres the no heat load temperature reached 36 K, a nearly 50% improvement over Pb in lowering the temperature drop relative to the stainless steel reference. This is a significant improvement considering the fact the volumetric heat capacity of $Er_{96.8}O_{2.7}C_{0.2}N_{0.3}$ alloy is only 28% larger than that of Pb at 45 K.

Cryocooler

Figure 1:
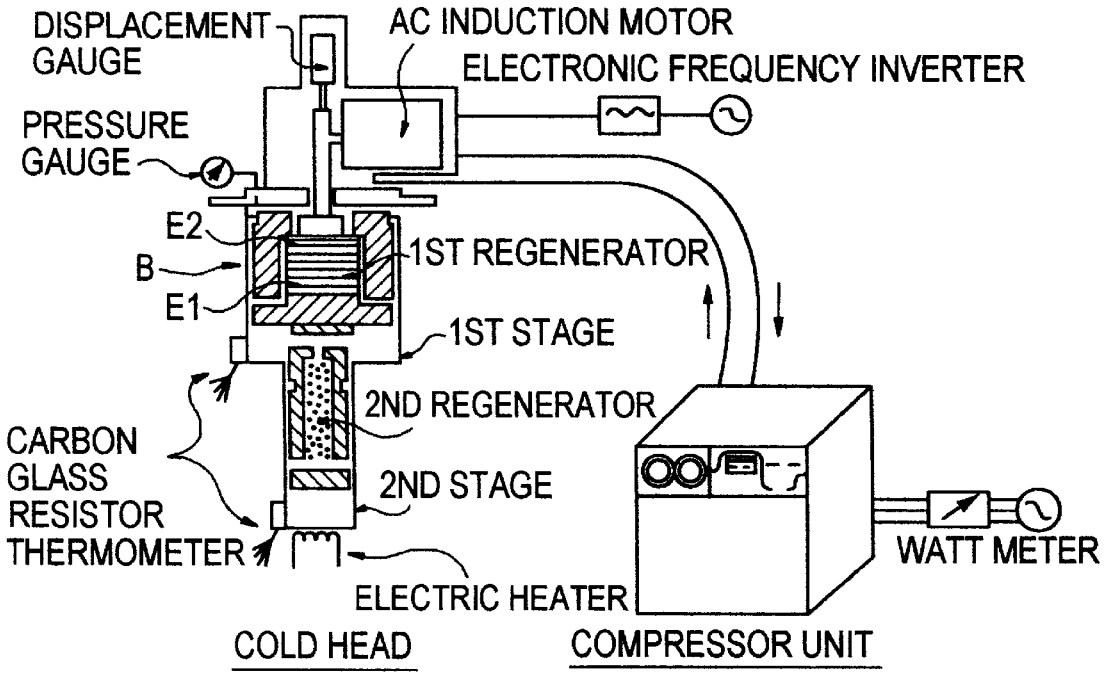
FIG. 1 PRIOR ART
FIG. 1 is a schematic illustration of a two stage Gifford-McMahon cryocooler wherein the cryocooler includes first and second stage regenerators for operation at different high and low temperature ranges or stages of operation.

Referring to FIG. 1, for purposes of illustration only, a two stage Gifford-McMahon (GM) cryocooler or refrigerator is shown and can be used to reach extremely low temperatures, such as approximately 4 K, without a liquid refrigerant. A two stage GM cryocooler or refrigerator is discussed in U.S. Pat. No. 5,186,765 and the Kuriyama et al. article "High Efficient Two-Stage GM Refrigerator With Magnetic Material In The Liquid Helium Temperature Region", *Adv. Cryogenic Eng.,* vol. 35, (1990) pages 1261–1289, the teachings of which are incorporated herein with respect to construction of the two stage GM cryocooler. The two stage GM cryocooler comprises a first relatively high temperature stage having a first regenerator comprising in the past bronze mesh or stainless steel (e.g. type 304 or 316 stainless steel) and a second stage having a relatively low temperature second regenerator comprising lead (Pb) or more recently $Er_3Ni$ intermetallic compound particulates or more likely a combination of lead and $Er_3Ni$ intermetallic compound layers.

The present invention provides an improved first stage regenerator for the first or higher temperature stage (i.e. 60 to 300 K) of the GM cryocooler or other cryocoolers and also for an intermediate temperature range (10 to 60 K) second stage regenerator. The latter could easily be combined with $Er_3Ni$ intermetallic compound or Nd to reach temperatures in the range of 4 K. The brittleness of $Er_3Ni$ intermetallic compound and the easy oxidation of Nd remains a problem. Therefore, such solid solution alloys as $Er_{50}Pr_{50}$ and others shown in FIGS. 12*a*, 12*b*, 12*c*, 14*a*, 14*b*, 15*a*, 15*b*, 16, and 17 could be used without $Er_3Ni$ and Nd to support cooling below 10 K. However, the present invention is not limited to GM cryocoolers and can be practiced in conjunction with other cryocoolers such as Stirling cryocoolers, pulse tube cryocoolers, and the like where a passive magnetic regenerator is employed for cooling in the temperature range generally from about 10 K upward to below 100 K, and more generally from approximately 300 K to approximately 10 K, and even below 10 K to approximately 4 K.

Figure 24:
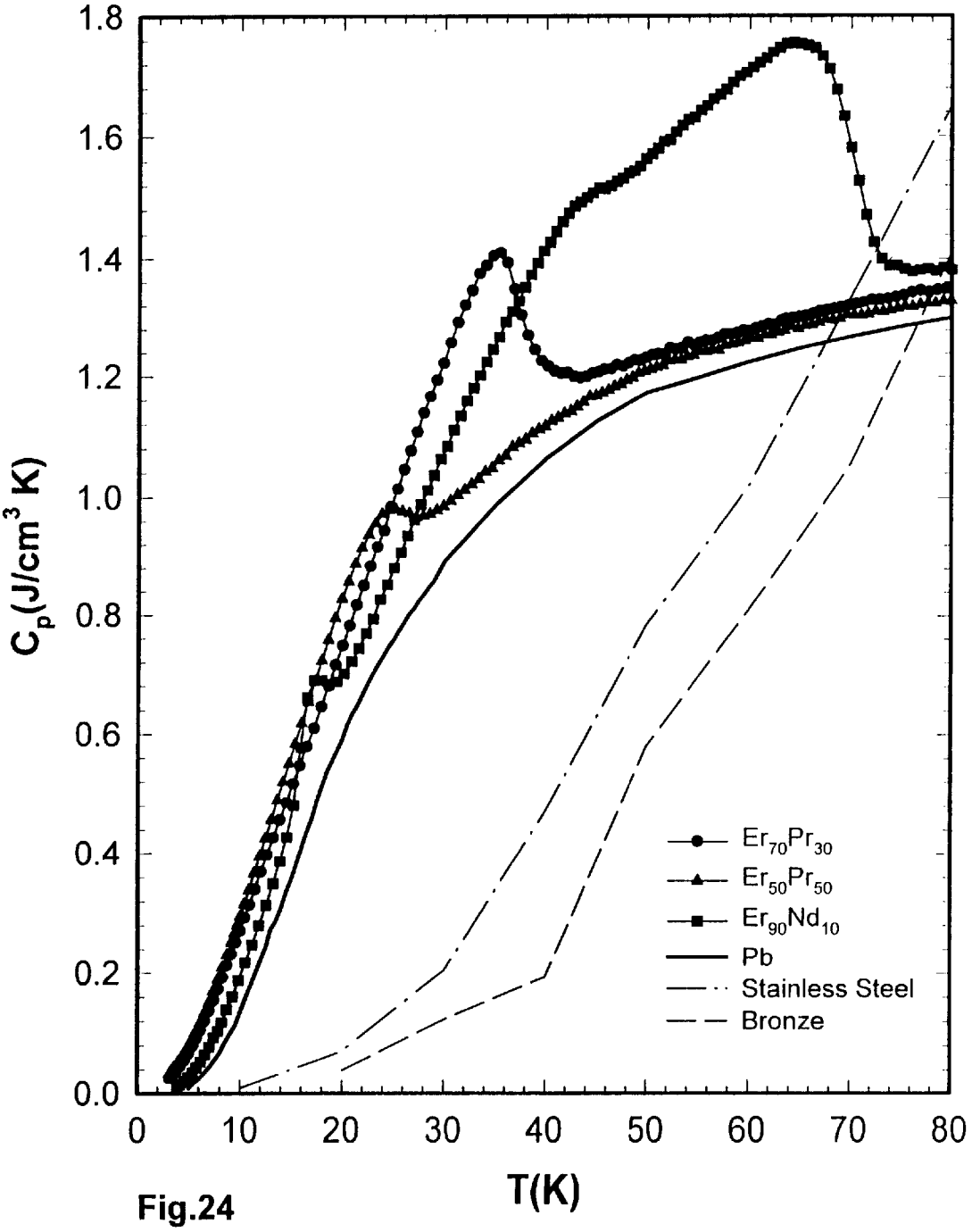

Referring to FIG. 1, one illustrative embodiment of the present invention involves providing the first stage of the GM cryocooler as a layered bed B comprising a first layer of an alloy $Dy_{80}Nd_{20}$ proximate the relatively cold end El of the bed (i.e. the end adjacent the second stage and second regenerator shown), a last layer of gadolinium (Gd) metal proximate the opposite, warm end E2 of the bed and a series of intermediate layers of, for example, the $Dy_{90}Nd_{10}$ (at the lowest temperature end, next to the first $Dy_{80}Nd_{20}$ layer), $Dy_{97.0}O_{2.5}C_{0.2}N_{0.3}$, $Tb_{30}Dy_{70}$, $Tb_{60}Dy_{40}$, $Tb_{98.0}O_{1.5}C_{0.3}N_{0.2}$, $Gd_{25}Tb_{75}$, $Gd_{50}Tb_{50}$, and $Gd_{75}Tb_{25}$ (at the highest temperature end, next to the final Gd layer) solid solution alloys between the first and last layers. This ten layer regenerator bed will be designated MMRE-1 (Multi Magnetic Rare Earth). FIG. 24 shows the combined heat capacity of the MMRE-1 ten layer regenerator. The first, second, and the other intermediate layers plus the last one (Gd) are in intimate contact at their interfaces or surfaces and can exemplary variable thicknesses between 0.1 to 0.4 inch, respectively, to this end, completely filling the regenerator bed.

The Er, Dy and Gd metals typically are commercially pure metals having less than 0.2 weight % incidental impurities. The rare earth alloy is made of commercially pure metal components; e.g. commercially pure Sc, Y, La, Ce, Pr, Nd, Sm, Eu, Gd, Tb, Dy, Ho, Er, Tm, Yb and Lu.

Referring to FIGS. 2 through 17, it is apparent that the magnetic rare earth metals Gd, Tb, Dy, Ho and Er shown in FIGS. 2*a* and 2*b* exhibit a volumetric heat capacity greater than that of bronze, stainless steel or lead (Pb) from 10 K to room temperature (295 K). It is important to note that the volumetric heat capacity of Er metal is greater than that of bronze, stainless steel and lead below about 85 K (FIG. 2*b*). For lead, however, the heat capacities of the two materials are comparable below 20 K (FIG. 2*b*).

For the first regenerator of FIG. 1 comprised of the ten layer combination described above, MMRE-1, with $Dy_{80}Nd_{20}$ solid solution alloy at the cold end El and Gd at the warm end E2, the volumetric heat capacity is between 50% to 150% larger than that of a lead (Pb) regenerator between 50 K and 300 K. Similarly, the average volumetric heat capacity of the MMRE-1 regenerator bed is 10 to 20% larger than that of bronze from 60 to 280 K; and 20 to 30% from 100 to 300 K, and 10 to 20% from 60 to 100 K for stainless steel. Thus the cooling power and efficiency of the MMRE-1 regenerator of the invention comprised of the combination of the ten layers described above is correspondingly improved between 50 K and 300 K as compared to the cooling power and efficiency of a regenerator using bronze or stainless steel as the regenerator material.

Figure 25:
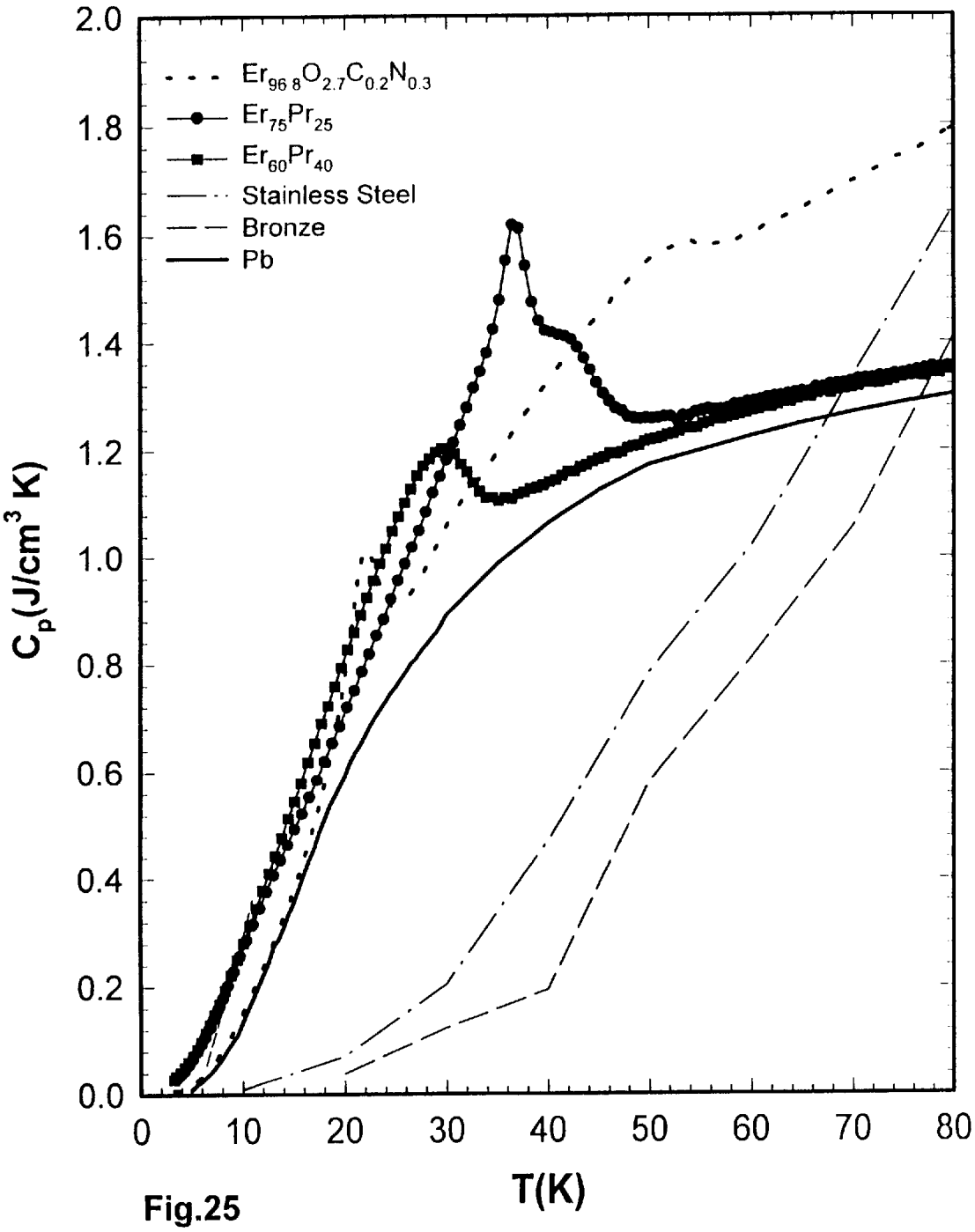

For the second regenerator of FIG. 1 comprised of a combination of the $Er_{50}Pr_{50}$ solid solution alloy (see FIGS. 12*a, b* and *c*, and 17) as lowest temperature layer, the $Er_{70}Pr_{30}$ solid solution alloy (see FIGS. 15*a* and 15*b*, and 16) as the intermediate temperature layer, and the $Er_{90}Nd_{10}$ solid solution alloy as the highest temperature layer (see FIGS. 9, 20*a* and *b*, and 21*a* and *b*) the volumetric heat capacity is between 33 and 185% larger than of a lead (Pb) regenerator between 10 and 65 K. The composite heat capacity of this regenerator combination, which is designated as MMRE-2, is shown in FIG. 25. Thus the cooing power and efficiency of the MMRE-2 regenerator of the invention comprised of the combination of $Er_{50}Pr_{50}$, $Er_{70}Pr_{30}$ and $Er_{90}Nd_{10}$ solid solution alloys is correspondingly improved between 10 K and 65 K as compared to the cooling power and efficiency of a regenerator using lead as the regenerator material.

Figure 26:
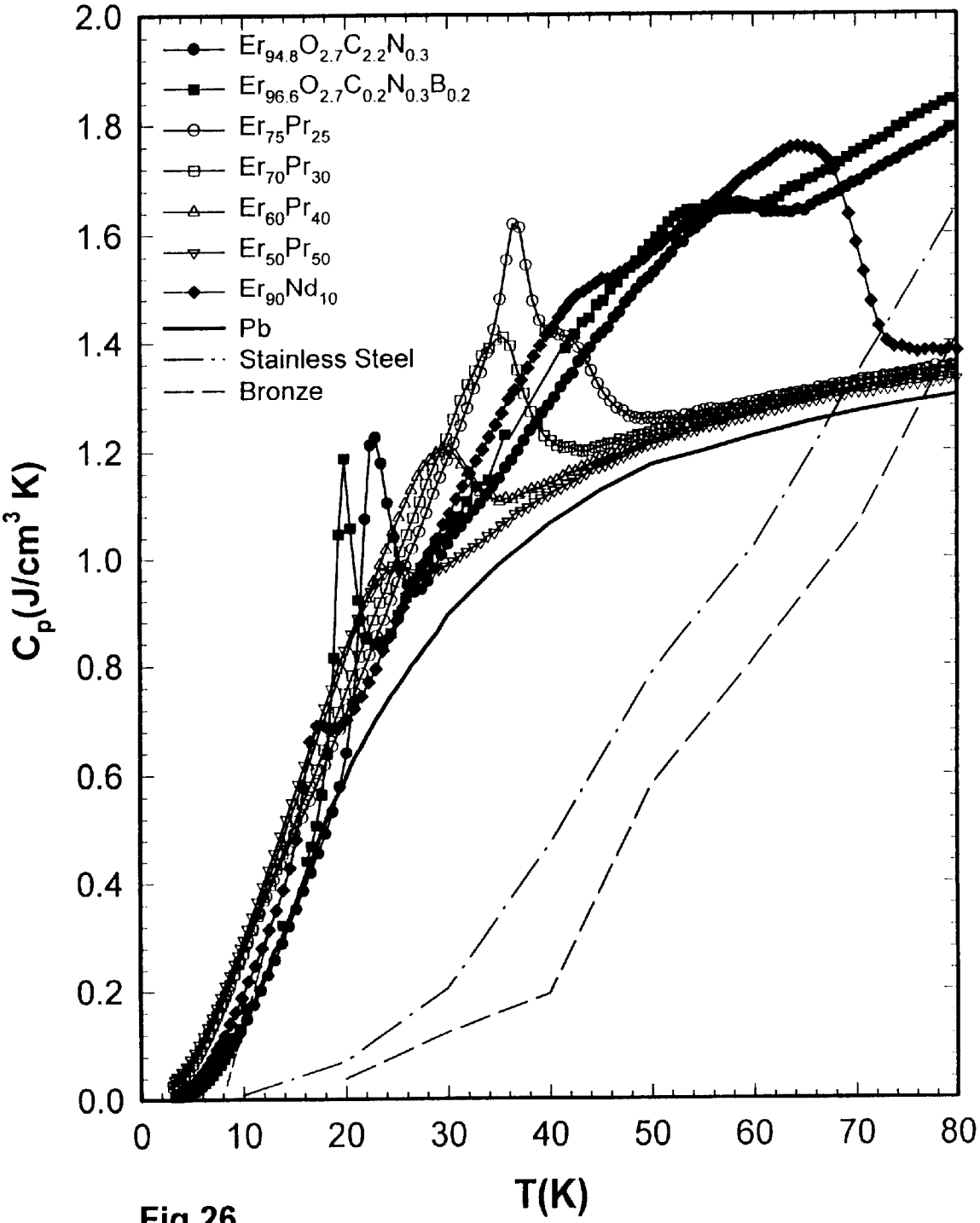

An alternate layered regenerator bed to MMRE-2 would comprise a combination of $Er_{60}Pr_{40}$ solid solution alloy (see FIGS. 15*a*, 15*b* and 17) as the lowest temperature layer, $Er_{75}Pr_{25}$ solid solution alloy (see FIGS. 15*a*, 15*b* and 17) as the intermediate temperature layer, and $Er_{96.8}O_{2.7}C_{0.2}N_{0.3}$ solid solution alloy as the highest temperature layer (see FIGS. 3*c*, 4*a*, 5*a*, 6, 7, 8, 9, 10, 11*a* and *b*, 12*a* and *b*, 14*a* and *b*, 15*a* and *b*, 16 and 20*a* and *b*) with a volumetric heat capacity between 25 and 175% larger than that of a lead regenerator between 10 and 80 K. This regenerator combination will be called MMRE-3, and the heat capacities of the three components are shown in FIG. 26.

A more complicated, seven layered regenerator as the lower temperature (second) stage can be constructed such that it would have the highest possible heat capacity over the 10 to 65 K temperature range and thus be the most efficient intermediate temperature regenerator. This seven layered regenerator bed (MMRE-4) would comprise a combination of the following Er-base solid solution alloys starting from the low temperature end of the regenerator and successively with increasing temperature of the optimum heat capacity eventually reaching the high temperature end at the seventh layer. These are: $Er_{50}Pr_{50}$ (see FIGS. 12*a, b* and *c*, and 17); $Er_{96.6}O_{2.7}C_{0.2}N_{0.3}B_{0.2}$ (see FIG. 7); $Er_{94.8}O_{2.7}C_{2.2}N_{0.3}$ (see FIG. 7); $Er_{60}Pr_{40}$ (see FIGS. 15*a* and *b*, and 17); $Er_{70}Pr_{30}$ (FIGS. 15*a* and *b*, and 16); $Er_{75}Pr_{25}$ (see FIGS. 15*a* and *b*, and 17); and $Er_{90}Nd_{10}$ (see FIGS. 9, 20*a* and *b*, and 21*a* and *b*).

Examples of regeneration stages and configurations for a high performance cryocooler to reach various temperatures are described below.

EXAMPLE 1

A cryocooler with enhanced cooling power down to about 50 K, consists of a single stage composed entirely of regenerator MMRE-1 described above.

EXAMPLE 2

Since the Gd, the top layer of MMRE-1, has a slightly lower heat capacity than that of bronze, this layer (Gd) would be replaced in MMRE-1 by bronze. A slight improvement in the cooling power/or the attainment of a lower temperature would be expected. This modified regenerator bed is designated MMRE-1a.

EXAMPLE 3

A high performance two stage cryocooler to reach 10 K consists of a first (high temperature) stage regenerator MMRE-1 (or MMRE-1a) and a second (low temperature) stage regenerator consisting of the three layered MMRE-2 (or MMRE-3) regeneration described above. MMRE-2 would be expected to have a slightly better performance than MMRE-3 because its heat capacities are slightly higher.

EXAMPLE 4.

Another combination of first and second stages to achieve good cooling, but simpler to assemble would be to use bronze (or stainless steel) as the upper temperature (first) stage regenerator. The lower temperature (second) stage would be either MMRE-2 or MMRE-3.

EXAMPLE 5.

The best performance two stage cryocooler to reach 10 K would consist of a first stage ten layered MMRE-1 (or MMRE-1a) regenerator and a second stage seven layered MMRE-4 regenerator.

EXAMPLE 6.

Using a bronze (or stainless steel) first stage regenerator and the MMRE-4 regenerator as the second stage regenerator would also be a useful and powerful cryocooler to attain temperatures as low as 10 K.

EXAMPLE 7.

To reach temperatures below 10 K with sufficient cooling at 4 K a three stage cryocooler would be required. However, a two stage unit with a modified lower temperature stage regenerator could also work. In the former case, a standard low temperature magnetic regeneration material, such as $Er_3Ni$ intermetallic compound, or Nd, or $HoCu_2$, would be used as the third (lowest temperature) in combination with one of the two stage regenerators described in Examples 3 through 6. In the latter case, one of the standard low temperature magnetic regenerator materials would become the lowest temperature layer of the second (low temperature stage) regenerator together with the other layers which make up regenerators MMRE-2, MMRE-3 and MMRE-4 as cited in Examples 3 through 6.

Reference

1. K. A. Gschneidner, Jr., "Systematics of the Intra-Rare-Earth Binary Alloy Systems", *J. Less-Common Metals* 114, 29–42 (1985).
2. C. Y. Ho, R. W. Powell and P. E. Liley, "Thermal Conductivity of the Elements: A Comprehensive Review", *J. Phys. Chem. Reference Data,* 3, Supplement No. 1, pp. I-258 to I-262 (Dy); I-263 to I-267 (Er); I-274 to I-278 (Gd) and I-398 to I-411 (Pb); (1974).
3. Anonymous, "Thermal Conductivity of Selected Commercial Alloys", p. 4–92 in *American Institute of Physics Handbook,* $2^{nd}$ ed., D. E. Gray, Ed. McGraw-Hill, New York (1963).
4. T. E. Scott, "Elastic and Mechanical Properties", Vol. 1, pp. 591–705 in *Handbook on Physics and Chemistry of Rare Earths,* K. A. Gschneidner, Jr. and L. Eyring, Eds., North-Holland/Elsevier, Amsterdam (1978)
5. Anonymous, p. 217 (Bronze) and p. 550 (Pb) in *Properties and Selection: Nonferrous Alloys and Special-Purpose Materials, Metals Handbook,* $10^{th}$ ed., Vol. 2 ASM Intern., Materials Park, Ohio (1990).
6. Anonymous, p. 855 in *Properties and Selection: Irons, Steels and High-Performance Alloys, Metals Handbook,* $10^{th}$ ed., Vol. 1, ASM Intern., Materials Park, Ohio (1990).

What is claimed is:

1. A cryocooler having a regenerator comprising a regenerator component selected from the group consisting of a solid solution alloy of two or more rare earth metals, a solid solution alloy of a rare earth metal with a non-rare earth metal selected from the group consisting of Mg, Ti, Zr, Hf, and Th, and a solid solution alloy of a rare earth metal with an interstitial element.

2.The cryocooler of claim 1 wherein the regenerator further comprises a component selected from the group consisting of copper and its alloys, stainless steel, lead and a rare earth metal.

3. The cryocooler of claim 1 wherein each said solid solution alloy includes a rare earth metal selected from the group consisting of La, Ce, Pr, Nd, Sm, Eu, Gd, Tb, Dy, Ho, Er, Tm, Yb, Lu, Sc, and Y.

4. The cryocooler of claim 1 wherein said regenerator component comprises a regenerator layer.

5. The cryocooler of claim 1 wherein said regenerator component comprises regenerator particles.

6. The cryocooler of claim 5 wherein the particles are spheres.

7. A cryocooler having a low temperature stage and a higher temperature stage, wherein at least one stage includes a passive magnetic regenerator comprising a regenerator component selected from the group consisting of a solid solution alloy of two or more rare earth metals, a solid solution alloy of a rare earth metal with a non-rare earth metal selected from the group consisting of Mg, Ti, Zr, Hf, and Th, and a solid solution alloy of a rare earth metal with an interstitial element.

8. The cryocooler of claim 7 wherein each said solid solution alloy includes a rare earth metal selected from the group consisting of La, Ce, Pr, Nd, Sm, Eu, Gd, Tb, Dy, Ho, Er, Tm, Yb, Lu, Sc, and Y.

9. The cryocooler of claim 7 wherein said regenerator component comprises a regenerator layer.

10. The cryocooler of claim 1 wherein said regenerator component comprises regenerator particles.

11. A passive magnetic regenerator comprising a component selected from the group consisting of a solid solution alloy of two or more rare earth metals, a solid solution alloy of a rare earth metal with a non-rare earth metal selected from the group consisting of Mg, Ti, Zr, Hf, and Th, and a solid solution alloy of a rare earth metal with an interstitial element.

12. The regenerator of claim 11 wherein each said solid solution alloy includes a rare earth metal selected from the group consisting of La, Ce, Pr, Nd, Sm, Eu, Gd, Tb, Dy, Ho, Er, Tm, Yb, Lu, Sc, and y.

13. The regenerator of claim 11 wherein said component comprises a regenerator layer.

14. The regenerator of claim 11 wherein said component comprises regenerator particles.

15. A cryocooler having a regenerator comprising a regenerator material comprising a solid solution alloy of two or more rare earth metals selected from the group consisting of La, Ce, Pr, Nd, Sm, Eu, Gd, Tb, Dy, Ho, Er, Tm, Yb, Lu, Sc, and Y.

16. A cryocooler having a regenerator comprising a regenerator material comprising a solid solution alloy of a rare earth metal and an interstitial element selected from the group consisting of H, B, C, N, O, and F.

17. A cryocooler having a regenerator comprising a regenerator material comprising a solid solution alloy of a rare earth metal and a non-rare earth metal selected from the group consisting of Mg, Ti, Zr, Hf, and Th.

18. A cryocooler having a regenerator comprising a plurality of regenerator components including a solid solution alloy of two or more rare earth metals and a solid solution alloy of a rare earth metal and an interstitial element.

19. A cryocooler having a low temperature stage and a higher temperature stage, wherein at least one stage includes a passive magnetic regenerator comprising a regenerator component selected from the group consisting of a solid solution alloy of two or more rare earth metals, a solid solution alloy of a rare earth metal with a non-rare earth metal selected from the group consisting of Mg, Ti, Zr, Hf, and Th, and a solid solution alloy of a rare earth metal with an interstitial element selected from the group consisting of H, B, C, N, O, and F.

20. A passive magnetic regenerator comprising a component selected from the group consisting of a solid solution alloy of two or more rare earth metals, a solid solution alloy of a rare earth metal with a non-rare earth metal selected from the group consisting of Mg, Ti, Zr, Hf, and Th, and a solid solution alloy of a rare earth metal with an interstitial element selected from the group consisting of H, B, C, N, O, and F.

21. The cryocooler of claim 1 wherein said regenerator component comprises wire, sheet, or foil.

22. The cryocooler of claim 7 wherein said regenerator component comprises wire, sheet, or foil.

23. The cryocooler of claim 1 wherein said regenerator has more than one said regenerator component to provide for cooling in the temperature range of about 10 K to about 300 K.

24. The cryocooler of claim 7 wherein said regenerator has more than one said regenerator component to provide for cooling in the temperature range of about 10 K to about 300 K.

25. The regenerator of claim 11 including more than one said component for cooling in the temperature range of about 10 K to about 300 K.

26. A cryocooler having a regenerator comprising a first regenerator component selected from the group consisting of a solid solution alloy of two or more rare earth metals, a solid solution alloy of a rare earth metal with a non-rare earth metal, and a solid solution alloy of a rare earth metal with an interstitial element and a second regenerator component selected from the group consisting of copper and its alloys, stainless steel, lead, and a rare earth metal.

27. The cryocooler of claim 6 wherein said spheres do not pulverize in use in the regenerator.

28. The cryocooler of claim 1 wherein said regenerator component comprises a porous monolith, rolled ribbon, or wire mesh.

* * * * *

UNITED STATES PATENT AND TRADEMARK OFFICE

CERTIFICATE OF CORRECTION

PATENT NO. : 6,318,090 B1
DATED : November 20, 2001
INVENTOR(S) : Karl A. Gschneidner, Jr. et al.

It is certified that error appears in the above-identified patent and that said Letters Patent is hereby corrected as shown below:

Column 1,
After line 3, insert:

-- CONTRACTUAL ORIGIN OF THE INVENTION

The United States Government has rights in this invention pursuant to Contract No. W-7405-ENG-82 between the U.S. Department of Energy and Iowa State University, Ames, Iowa, which contract grants to Iowa State University Research Foundation, Inc. the right to apply for this patent. --.

Column 15,
Line 13, repalce "y" with -- Y --.

Signed and Sealed this

Second Day of April, 2002

*Attest:*

*Attesting Officer*

JAMES E. ROGAN
*Director of the United States Patent and Trademark Office*